US007334882B2

(12) United States Patent
Nakazawa

(10) Patent No.: US 7,334,882 B2
(45) Date of Patent: Feb. 26, 2008

(54) INK CONCENTRATION DETECTING METHOD, INK CONCENTRATION DETECTING APPARATUS, AND INK JET RECORDING APPARATUS USING THE SAME

(75) Inventor: Yusuke Nakazawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/998,061

(22) Filed: Nov. 29, 2004

(65) Prior Publication Data

US 2005/0116982 A1 Jun. 2, 2005

(30) Foreign Application Priority Data

Nov. 28, 2003 (JP) ..... 2003-398957

(51) Int. Cl.
*B41J 2/09* (2006.01)

(52) U.S. Cl. ..... 347/77

(58) Field of Classification Search ..... 347/43, 347/15, 7, 84–85

See application file for complete search history.

(56) References Cited

U.S. PATENT DOCUMENTS 4,635,078 A * 1/1987 Sakurada et al. ..... 347/15
5,614,931 A * 3/1997 Koike et al. ..... 347/43
6,158,844 A 12/2000 Murakami et al.
6,161,911 A * 12/2000 Minemoto et al. ..... 347/7
6,164,760 A 12/2000 Mizoguchi et al.

FOREIGN PATENT DOCUMENTS

JP 10-138493 A 5/1998
JP 2834100 B2 10/1998

* cited by examiner

*Primary Examiner*—K. Feggins
(74) *Attorney, Agent, or Firm*—Sughrue Mion, PLLC

(57) ABSTRACT

The ink concentration detecting method and apparatus detect ink concentration of ink containing charged colorant particles. The method and apparatus detect ejection state of ink droplets ejected by causing predetermined electrostatic force to act on the ink, and detect the ink concentration in correspondence to the detected ejection state of the ink droplets. The apparatus includes an ejection detecting device for detecting the ejection state and a concentration detecting device for detecting the ink concentration. The electrostatic ink jet recording apparatus includes an ink ejecting device for ejecting the ink droplets at predetermined frequency corresponding to the ink concentration and the ink concentration detecting apparatus.

22 Claims, 8 Drawing Sheets

INK CONCENTRATION DETECTING METHOD, INK CONCENTRATION DETECTING APPARATUS, AND INK JET RECORDING APPARATUS USING THE SAME

This application claims priority on Japanese patent application No. 2003-398957, the entire contents of which are hereby incorporated by reference.

BACKGROUND OF THE INVENTION

The present invention relates to a method of detecting ink concentration in an ink jet recording apparatus, an ink concentration detecting apparatus with which the ink concentration detecting method is implemented, and an ink jet recording apparatus using the ink concentration detecting apparatus.

As for a recording method in which ink droplets each containing colorant particles are ejected onto a recording medium to record an image thereon, there is for example an electrostatic ink jet recording system in which ink containing charged colorant particle components is used, and ejection of the ink droplets is controlled by utilizing an electrostatic force generated by applying predetermined voltages (drive voltages) to ejection electrodes (drive electrodes) of an ink jet head in accordance with image data to thereby record an image corresponding to the image data on a recording medium.

Known as an example of a recording apparatus using the electrostatic ink jet recording system is an ink jet recording apparatus disclosed in JP 10-138493 A.

FIG. 9 is a schematic view showing an ink jet head used in the electrostatic ink jet recording apparatus disclosed in JP 10-138493 A.

An ink jet head 200 includes a head substrate 202, an ink guide 204, an insulating substrate 206, a control electrode 208, a D.C. bias voltage source 210, and a signal voltage source (pulse voltage source) 212.

A through hole 214 through which ink is to be ejected is formed so as to extend perfectly through the insulating substrate 206. The head substrate 202 is provided in a position apart from the insulating substrate 206 by a predetermined distance, and ink guides 204 are disposed in positions on the head substrate 202 corresponding to the through holes 214. The ink guide 204 extends perfectly through the through hole 214 so as for its tip portion 204*a* to project upwardly and beyond a surface of the insulating substrate 206 on a side of a recording medium P.

In addition, the recording medium P is disposed in a position where the recording medium P faces the tip portion of the ink guide 204. A counter electrode 218 serving as a platen as well for guiding the recording medium P is disposed in a rear surface of the recording medium P opposite to the head substrate 202. Also, the counter electrode 218 is grounded.

The head substrate 202 is disposed at a predetermined distance from the insulating substrate 206. Thus, an ink flow path 216 is defined between the head substrate 202 and the insulating substrate 206.

The ink containing colorant particles which are charged to the same polarity as that of a voltage applied to the control electrode 208 is made to circulate through the ink flow path 216 from the right-hand side to the left-hand side in FIG. 9, for example, by a circulation mechanism for ink (not shown). Thus, the ink is supplied to the corresponding ones of the through holes 214.

The control electrode 208 is provided in a ring-like shape on the surface of the insulating substrate 206 on the side of the recording medium P so as to surround the periphery of the through hole 212. In addition, the control electrode 208 is connected to the pulse voltage source 212 for generating a pulse voltage in accordance with image data. The pulse voltage source 212 is grounded through the D.C. bias voltage source 210.

In such an electrostatic ink jet recording apparatus, in a state where no pulse voltage is applied to the control electrode 208, the Coulomb attraction between the bias voltage and the charged toner particles (colorant particles) in the ink, the viscosity of the ink (carrier liquid), the surface tension, the resiliencies between the charged particles, the fluid pressure when the ink is supplied, and the like operate in conjunction with one another. Thus, the balance is obtained among these factors in a state where as shown in FIG. 4, the ink has a meniscus shape of slightly rising from the through hole 214.

In addition, the colorant particles migrate to the meniscus surface due to the Coulomb attraction or the like, i.e., there is provided a state where the ink is concentrated on the meniscus surface.

When the voltage is applied to the control electrode 208 (ejection is ON), the bias voltage is superposed on the drive voltage so that the ink is attracted towards a side of the recording medium P to form a nearly conical shape, i.e., a so-called Taylor cone.

When a time elapses after application of the voltage to the control electrode, the balance between the Coulomb attraction acting on the colorant particles and the surface tension of the carrier liquid is broken. As a result, there is formed a slender ink liquid column having a diameter of about several microns to several tens of microns which is called a thread. When a time further elapses, a tip portion of the thread is divided, and as a result, droplets of the ink are ejected to fly towards the recording medium P by the electrostatic attraction force.

In the electrostatic ink jet recording process, normally, a modulated pulse voltage is applied to the corresponding ones of the control electrodes 208 to turn ON/OFF the corresponding ones of the control electrodes 208 to eject ink droplets. Thus, the ink droplets are ejected on demand in correspondence to an image to be recorded.

Hence, the division of the thread is caused at a frequency much higher than the drive frequency for the pulse voltage used to eject the ink droplets. That is, the division of the thread is continuously caused multiple times for a time period required to apply a pulse voltage to the corresponding ones of the control electrodes once. Consequently, one dot on the recording medium P is formed with a plurality of minute droplets which were separately ejected.

In such an ink jet recording apparatus, if the concentration (ink concentration) of the colorant particles contained in the ink changes, the concentration property of the colorant particles in a through hole (ejection hole), a size of the formed thread, an ejection frequency of the ink droplets, and the like change accordingly. Hence, the control for the concentration of the colorant particles contained in the ink to be supplied to the ejection portion is very important in terms of the control for the ejection of the ink droplets.

Then, JP 2,834,100 B discloses an electrostatic ink jet recording apparatus having ink containing charged toner particles (charged colorant particles), ejection electrodes for ejecting the toner particles in the ink from an ejection opening portion towards a recording medium, and a counter electrode provided so as to be opposite to the ejection opening portion through the recording medium, the electrostatic ink jet recording apparatus including means for detecting an amount of colorant particles in an ink flow using a magnetic sensor, or a light emitting element and a light receiving element, means for judging an amount of detected toner particles, and means for supplying the toner particles to the ink flow based on the judgment results.

In such a manner, the concentration of the toner particles flowing in the ink flow is measured, and the ink is added based on the measurement results, thereby controlling the ink concentration.

However, in the electrostatic ink jet recording apparatus disclosed in JP 2,834,100 B, the detection means is contaminated as the detection means is used, and thus the contamination component becomes noises to exert an influence on the concentration of the toner particles (hereinafter be referred to as "ink concentration") detected by the detection means. Moreover, a degree of contamination increases along with the use of the detection means.

For this reason, there is encountered a problem in that when the electrostatic ink jet recording apparatus is used for a long time, a difference occurs between the detected ink concentration and the actual ink concentration in the ink flow, and hence it becomes impossible to detect the precise ink concentration. In addition, this difference normally becomes larger with a lapse of time.

Moreover, since the ink concentration cannot be precisely detected, the ink concentration cannot be precisely controlled accordingly. Hence, there is also encountered a problem in that the ink of a suitable concentration cannot be supplied to the ink jet head, and as a result a high-quality image cannot be stably recorded.

SUMMARY OF THE INVENTION

In light of the foregoing, the present invention has been made in order to solve the above-mentioned problems. It is, therefore, a first object of the present invention to provide an ink concentration detecting method with which precise ink concentration (toner concentration) can be stably detected for a long term.

A second of the present invention is to provide an ink concentration detecting apparatus which is capable of detecting precise ink concentration by utilizing the ink concentration detecting method.

A third object of the present invention is to provide an ink jet recording apparatus which is capable of recording an image with an ink of suitable concentration, and of stably recording a high-quality image by utilizing the ink concentration detecting apparatus.

In order to attain the above-mentioned first object, the first aspect of the present invention provides an ink concentration detecting method of detecting ink concentration of an ink containing charged colorant particles, characterized in that ink droplets are ejected by causing a predetermined electrostatic force to act on the ink, an ejection state of the ejected ink droplets are detected, and the ink concentration is detected in correspondence to the detected ejection state of the ink droplets.

Also, in order to attain the above-mentioned second object, the second aspect of the present invention provides an ink concentration detecting apparatus for detecting ink concentration of an ink containing charged colorant particles, including: ejection detecting means for detecting an ejection state of ink droplets ejected by causing a predetermined electrostatic force to act on the ink; and concentration detecting means for detecting the ink concentration in correspondence to the ejection state of the ink droplets detected by the ejection detecting means.

In addition, preferably, the ejection state is an ejection frequency of the ink droplets, or the number of ejection of the ink droplets per unit time.

In addition, preferably, the ejection detecting means includes optical detection means or electrical detection means.

In addition, preferably, the optical detection means includes a light emitting portion and a light receiving portion which are disposed in positions facing each other through a flight path of the ink droplets ejected by the ink jet ejecting means.

In addition, preferably, the electrical detection means includes an electrode to which the ejected ink droplet is adhered, and current detecting means for detecting a current which is caused to flow when the ink droplet is adhered to the electrodes.

Also, in order to attain the above-mentioned third object, the third aspect of the present invention provides an electrostatic ink jet recording apparatus for ejecting ink droplets at a predetermined frequency corresponding to ink concentration by causing an electrostatic force to act on an ink containing charged colorant particles, the ink jet recording apparatus including an ink concentration detecting apparatus according to any one of the above-mentioned ink concentration detecting apparatus of the second aspect of the present invention.

Moreover, preferably, the ink jet recording apparatus further includes ink concentration adjusting means for adjusting the ink concentration to be ejected by the ink ejecting means in correspondence to the ink concentration detected by the ink concentration detecting apparatus.

In addition, preferably, the ink concentration adjusting means includes: high concentration ink supplying means for supplying high ink concentration of ink whose ink concentration which denotes concentration of the colorant particles contained in the ink is higher than a reference value; and low concentration ink supplying means for supplying low ink concentration of ink whose ink concentration which denotes the concentration of the colorant particles contained in the ink is lower than the reference value, and when the ink concentration detected by the ink concentration detecting means is higher than the reference value, the ink concentration adjusting means supplies the high ink concentration of ink from the high concentration ink supplying means, and when the ink concentration detected by the ink concentration detecting means is lower than the reference value, the ink concentration adjusting means supplies the low ink concentration of ink from the low concentration ink supplying means.

In addition, preferably, the ink concentration adjusting means includes: high concentration ink supplying means for supplying an ink of high ink concentration, concentration of colorant particles contained in the ink being higher than a reference value; and low concentration ink supplying means for supplying an ink of low ink concentration, concentration of colorant particles contained in the ink being lower than the reference value, and when the ink concentration detected by the ink concentration detecting means is higher than the reference value, supplies the ink of high concentration from the high concentration ink supplying means, and when the ink concentration detected by the ink concentration detecting means is lower than the reference value, supplies the ink of low concentration from the low concentration ink supplying means.

In addition, preferably, the detection of the ink concentration by the ink concentration detecting apparatus is carried out independently of recording on a recording medium.

With the ink concentration detecting method of the first aspect of the present invention, since the ink concentration is detected without contacting the ink, the ink concentration can be stably and precisely detected for a long term without suffering an influence of noises resulting from contamination or the like due to contact with the ink.

In addition, with the ink concentration detecting apparatus of the second aspect of the present invention, the ink concentration can be stably and precisely detected for a long term.

Moreover, with the ink jet recording apparatus of the third aspect of the present invention, the ink concentration is adjusted based on the stable and precise concentration detection for a long term, thereby allowing the ink concentration to be suitably kept, and the recording is carried out with the ink of suitable concentration, thereby allowing a high-quality image to be recorded stably for a long time.

DETAILED DESCRIPTION OF THE INVENTION

An ink concentration detecting method, an ink concentration detecting apparatus using the ink concentration detecting method, and an ink jet recording apparatus using the ink concentration detecting apparatus of the present invention will hereinafter be described in detail based on preferred embodiments shown in the accompanying drawings.

Figure 1A:
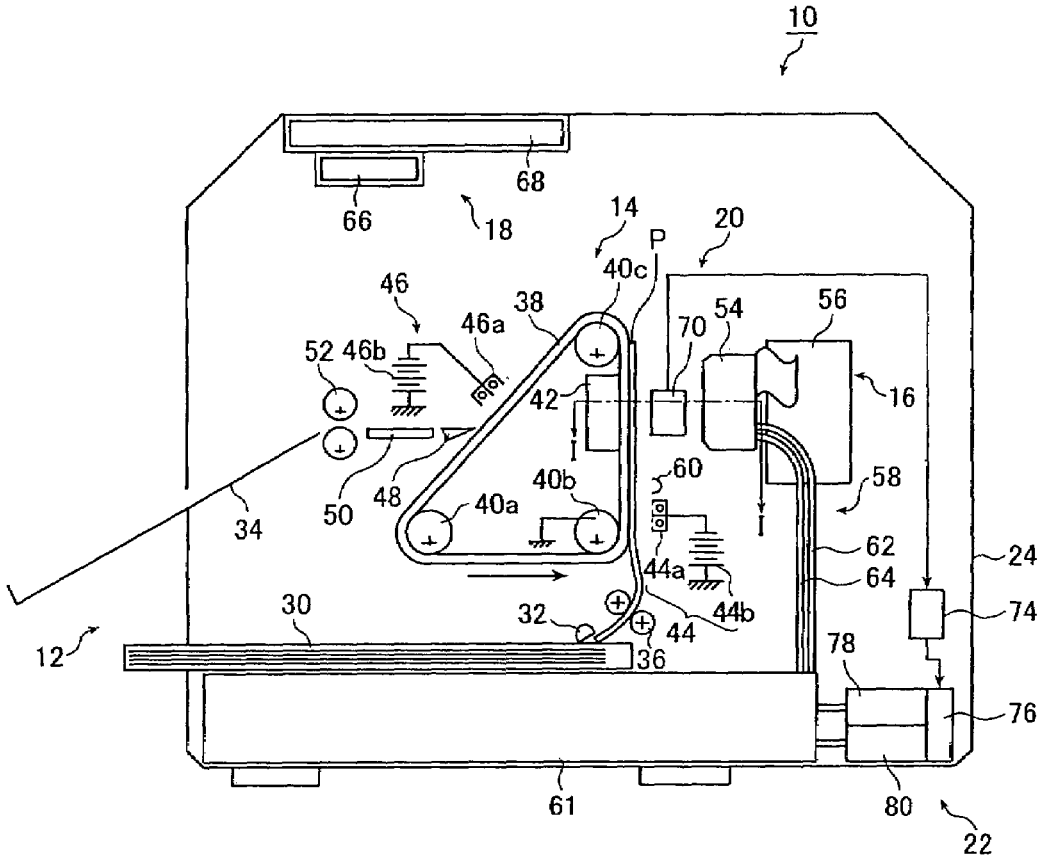
FIGS. 1A and 1B are a schematic view showing an overall construction of an electrostatic ink jet recording apparatus according to an embodiment of the present invention, and a cross sectional view taken along the line I-I of FIG. 1A.
Figure 1B:
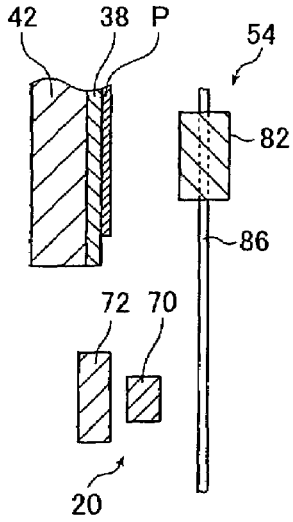

FIG. 1A is a schematic view showing an overall construction of an ink jet recording apparatus according to an embodiment of the present invention. FIG. 1B is a cross sectional view taken along the line I-I of FIG. 1A.

An ink jet recording apparatus 10 shown in FIG. 1A is an electrostatic type ink jet recording apparatus with which ejection of ink containing charged colorant particles is controlled by utilizing an electrostatic force to record a monochrome image on a recording medium P. The ink jet recording apparatus 10 includes means 12 for holding the recording medium P, conveyance means 14, recording means 16, solvent collection means 18, ink concentration detecting means 20, ink concentration adjusting means 22 and a casing 24.

The means 12 for holding the recording medium P includes a sheet feeding tray 30 for holding the recording medium P before the recording, a feed roller 32, and a sheet discharging tray 34 for holding the recording medium P after completion of the recording.

A front end portion of the sheet feeding tray 30 is inserted into the inside of an installation portion for the sheet feeding tray 30 (provided on a lower portion on the left-hand side of the casing 24 in FIG. 1A). In this connection, the sheet feeding tray 30 is detachably inserted into a predetermined position of the installation portion. In a state in which the sheet feeding tray 30 is perfectly installed in the installation portion, the front end portion of the sheet feeding tray 30 in an insertion direction contacts an inner end portion of the installation portion, and a rear end portion of the sheet feeding tray 30 projects outwardly from the casing 24. In addition, the feed roller 32 is disposed in the vicinity of an inner portion of the installation portion for the sheet feeding tray 30.

A plurality of sheets of the recording medium P before the recording are stocked on top of one another within the sheet feeding tray 30. In recording an image, the sheets are taken out one by one from the sheet feeding tray 30 by the feed roller 32 to be supplied to the conveyance means 14 for the recording medium P.

The discharge tray 34 is disposed in the vicinity of a discharge portion for the recording medium P (corresponding to a central portion on the left-hand side of the casing 24 in the figure) so that a front end portion side (toward which the recording medium P is conveyed) is located outside the casing 24, and a rear end portion thereof is located inside the casing 24. In addition, the discharge tray 34 is disposed at a predetermined inclination angle with respect to a horizontal line so that the front end portion thereof is lower in position than the rear end portion thereof.

The recording medium P after completion of the recording are conveyed by the conveyance means 14 to be discharged through the discharge portion, and are then successively stocked on top of one another within the discharge tray 34.

Subsequently, the conveyance means 14 for the recording medium P will be described.

The conveyance means 14 is means for electrostatically attracting the recording medium P to convey the recording medium P along a predetermined path from the sheet feeding tray 30 to the discharge tray 34. The conveyance means 14 includes a conveyance roller pair 36, a conveyor belt 38, belt rollers 40*a*, 40*b*, and 40*c*, an electrically conductive platen 42, a charger 44 and a discharger 46 for the recording medium P, a separation claw 48, a guide 50, and a fixing roller pair 52.

The conveyance roller pair 36 is provided in a position between the feed roller 32 and the conveyor belt 38 on the conveyance path for the recording medium P.

The recording medium P taken out from the sheet feeding tray 30 by the feed roller 32 is held and conveyed by the conveyance roller pair 36 to be supplied to a predetermined position on the conveyor belt 38.

The charger 44 for the recording medium P includes a scorotron charger 44*a* and a negative high voltage power source 44*b*. The scorotron charger 44*a* is disposed in a position between the conveyance roller pair 36 and the recording means 16 along the conveyance path for the recording medium P, i.e., in a position where the charger 44*a* is opposed to the surface of the conveyor belt 38 on which the recording medium P is supplied by the conveyance roller pair 36. In addition, a negative side terminal of the negative high voltage power source 44*b* is connected to the scorotron charger 44*a*, and a positive side terminal of the negative high voltage power source 44*b* is grounded.

The surface of the recording medium P is uniformly charged to a predetermined negative high voltage by the scorotron charger 44*a* connected to the negative high voltage power source 44*b*, and thus is in a state of being always biased at a given D.C. bias voltage (e.g., about −1.5 kV). As a result, the recording medium P is electrostatically attracted to the surface of the conveyor belt 38 having an insulation property.

The conveyor belt 38 is a ring-shaped endless belt, and is stretched in a triangular shape around the three belt rollers 40*a*, 40*b*, and 40*c*. In addition, the flat plate-like conductive platen 42 is disposed in an inner portion of the conveyor belt 38 in a position corresponding to the recording means 16.

A face of the conveyor belt 38 on which the recording medium P is to be electrostatically attracted (front side) has the insulation property, and a face of the conveyor belt 38 adapted to contact the belt rollers 40*a*, 40*b*, and 40*c* (rear side) has the conduction property. The belt roller 40*b* is grounded, and hence the belt rollers 40*a* and 40*c*, and the conductive platen 42 are also grounded through the rear surface of the conveyor belt 38. As a result, a portion of the conveyor belt 38 in a position where the belt 38 faces the recording means 16 functions as a counter electrode of the ink jet head to be described later.

At least one of the belt rollers 40*a*, 40*b*, and 40*c* is connected to a drive source (not shown), and is driven and rotated at a predetermined speed during the recording. As a result, during the recording, the conveyor belt 38 is moved in a direction indicated by an arrow in the figure. Consequently, as the conveyor belt 38 moves, the recording medium P is moved to be conveyed while the recording medium P faces the recording means 16.

The discharger 46 for the recording medium P includes a corotron discharger 46*a* and a high voltage power source 46*b*. The corotron discharger 46*a* is disposed in a position between the recording means 16 and the separation claw 48 along the conveyance path for the recording medium P, i.e., in a position where the discharger 46*a* is opposed to the surface of the conveyor belt 38 on which the recording medium P after completion of the recording is conveyed. In addition, one terminal of the high voltage power source 46*b* is connected to the corotron discharger 46*a*, and the other terminal of the high voltage power source 46*b* is grounded.

The electric charges on the recording medium P after completion of the recording are discharged by the corotron discharger 46*a* connected to the high voltage power source 46*b*. As a result, the recording medium P becomes easy to be separated from the conveyor belt 38.

In addition, the separation claw 48, the guide 50, and the fixing roller pair 52 are disposed in this order on a downstream side of the discharger 46 along the conveyance path for the recording medium P.

The recording medium P the electric charges on which have been discharged by the discharger 46 is separated from the conveyor belt 38 by the separation claw 48 to be supplied to the fixing roller pair 52 along the guide 50. The fixing roller pair 52 is a pair of rollers including a heat roller. An image recorded on the recording medium P is fixed through the contact and the heating while the recording medium P is held and conveyed by the fixing roller pair 52. The recording medium P after completion of the fixation is discharged through the discharge portion to be successively stacked on top of one another within the discharge tray 34.

Subsequently, the recording means 16 for the recording medium P will be described.

The recording means 16 is used to record a monochrome image on the recording medium P with the electrostatic force. The recording means 16 includes a head unit 54, a head driver 56, an ink circulation system 58 and a position detector 60 for detecting a position of the recording medium P.

The head unit 54 is disposed at a predetermined distance away from the surface of the recording medium P conveyed by the conveyor belt 38 so that the head unit 54 is opposed to the surface of the conveyor belt 38 in a position where the conductive platen 42 is disposed. While details will be described later, the head unit 54 includes a recording head 88 for ejecting ink droplets to record an image on the surface of the recording medium P, and thus records an image on the surface of the recording medium P by performing the serial scanning in which it is repeated that the ink is ejected while the main scanning with the recording head 88 is carried out for the recording medium P in a direction perpendicular to a direction of conveyance of the recording medium P, and the recording medium P is then conveyed by only a fixed amount.

An example of a head unit used in this embodiment will hereinafter be described with reference to FIG. 2.

Figure 2:
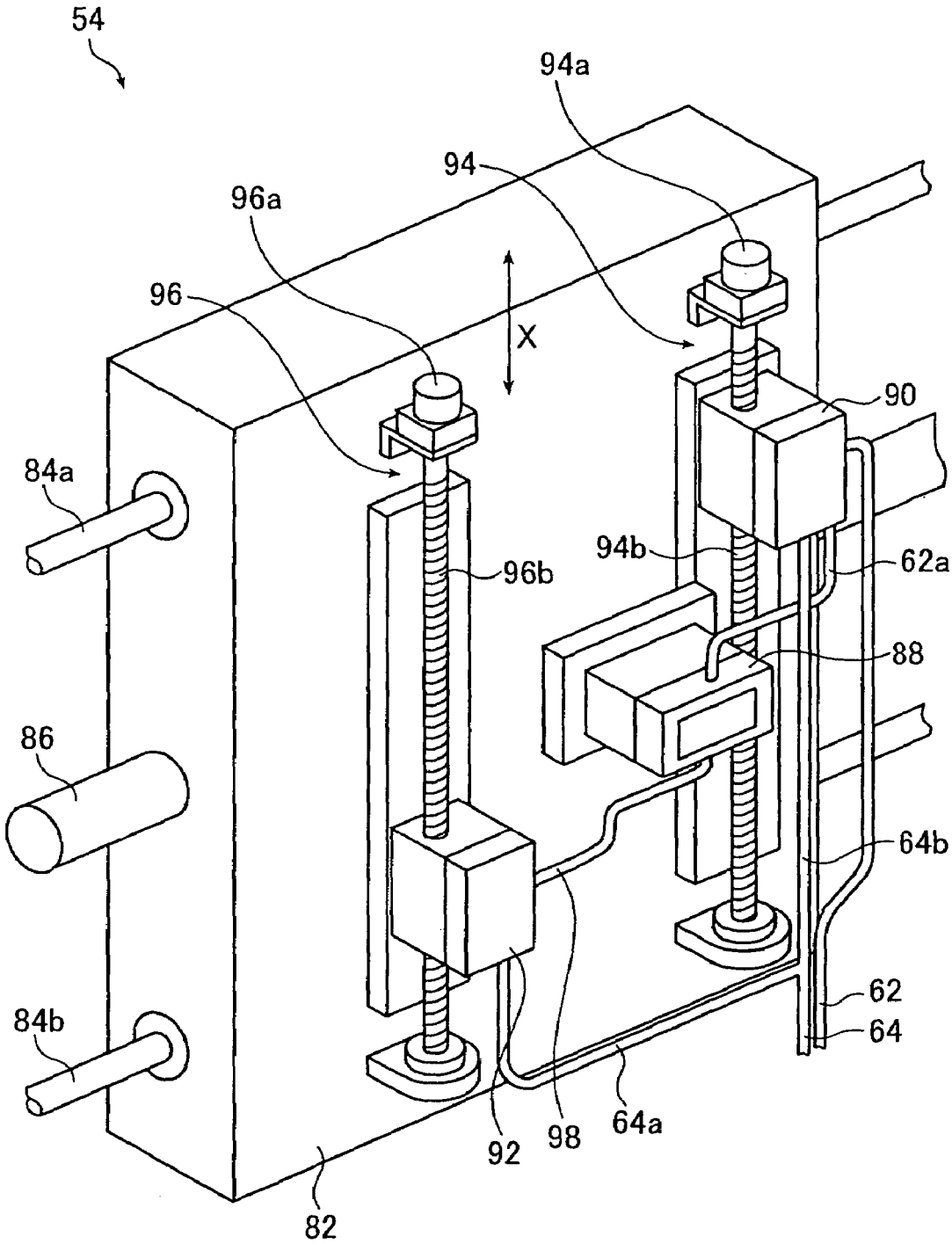
FIG. 2 is an enlarged perspective view of a head unit shown in FIG. 1A.

FIG. 2 is an enlarged perspective view showing a construction of the head unit 54. In the figure, a direction indicated by an arrow X is the direction of conveyance of the recording medium P by the conveyor belt 38.

The head unit 54 includes a support member 82, guide rails 84*a* and 84*b*, drive means 86, the recording head 88, an ink supply sub-tank 90, an ink recovery sub-tank 92, and a sub-tank position adjusting mechanism (including a portion 94 on a side of the supply sub-tank 90 and a portion 96 on a side of the recovery sub-tank 92).

The guide rails 84*a* and 84*b* are disposed at a predetermined distance away from each other, and are also disposed along a direction perpendicular to the direction of movement of the conveyor belt 38 (the direction indicated by the arrow X).

The drive means 86 is comprised of a ball screw and the like adapted to be driven by a motor (not shown), and is disposed between the guide rails 84*a* and 84*b* so as to be parallel with the guide rails 84*a* and 84*b*.

The support member 82 is supported by the guide rails 84*a* and 84*b* and the drive means 86, and is adapted to be moved by the drive means 86 in the direction perpendicular to the direction of movement of the conveyor belt 38 (the direction indicated by the arrow X) along the guide rails 84*a* and 84*b*. In addition, the support member 82 has a plate-like shape. The recording head 88, the ink supply sub-tank 90, the ink recovery sub-tank 92, and the sub-tank position adjusting mechanism (including the portion 94 on the side of the supply sub-tank 90 and the portion 96 on the side of the recovery sub-tank 92) are disposed on the support member 82.

The recording head 88 is fixed on the support member 82, and includes a monochrome ink jet head for recording a monochrome image using black (K) ink for example. The ink jet head used in the recording head 88 will be described in detail later.

The sub-tank position adjusting mechanism (including the portion 94 on the side of the supply sub-tank 90 and the portion 96 on the side of the recovery sub-tank 92) disposed on the support member 82 includes motors 94*a* and 96*a*, and ball screws 94*b* and 96*b*. The ball screws 94*b* and 96*b* are disposed along the direction indicated by the arrow X in order to support the supply sub-tank 90 and the recovery sub-tank 92, respectively.

The sub-tank position adjusting mechanisms 94 and 96 are adapted to drive the ball screws 94*b* and 96*b* using the motors 94*a* and 96*a* to move the ink supply sub-tank 90 and the ink recovery sub-tank 92 in the direction indicated by the arrow X, respectively, thereby adjusting the positions of the ink supply sub-tank 90 and the ink recovery sub-tank 92.

Here, the sub-tank position adjusting mechanism is not intended to be limited to the above-mentioned construction, and various other position adjusting mechanisms can be utilized for the sub-tank position adjusting mechanisms 94 and 96. In addition, since the positions of the ink supply sub-tank 90 and the ink recovery sub-tank 92 are not frequently changed, there may also be adopted such a construction that the positions of the ink supply sub-tank 90 and the ink recovery sub-tank 92 are manually adjusted.

The ink supply sub-tank 90 is connected to an ink tank 61 (refer to FIG. 1A) of the ink circulation system 58 which will be described later through an ink supply passage 62, and is adapted to supply the ink from the ink tank 61 to the recording head 88 through an ink supply passage 62*a*.

Here, the ink which is excessively supplied to the ink supply sub-tank 90 is caused to flow through the ink recovery passage 64*b* by utilizing a hydrostatic pressure to be recovered into the ink tank 61. As a result, an amount of ink collected in the ink supply sub-tank 92 is kept constant.

The recording head 88 records an image using the ink supplied thereto, and the ink which has not been used in the recording head 88 is recovered into the ink recovery sub-tank 92 through an ink flow path 98.

The ink recovery sub-tank 92 is connected to the ink tank 61 through the ink recovery passages 64*a* and 64. Thus, the ink recovered into the ink recovery sub-tank 92 is then recovered into the ink tank 61. Here, the ink recovery sub-tank 92 is adapted to keep a surface of the ink at a fixed level by utilizing the hydrostatic pressure as in the case of the ink supply sub-tank 90.

Thus, since the surfaces of the ink in the ink supply sub-tank 90 and the ink recovery sub-tank 92 are kept at the fixed levels, respectively, a pressure of the ink applied to the recording head 88 becomes constant.

As described above, the head unit 54 carries out the recording by performing the serial scanning in which it is repeated that the ink is ejected while the main scanning with the recording head 88 (the support member 82) is carried out in the direction perpendicular to the direction of conveyance of the recording medium P, and the recording medium P is then conveyed by a fixed amount.

Here, a concrete example of an electrostatic ink jet head 100 used in the recording head 88 of this embodiment for ejecting ink containing charged colorant particles are shown in FIGS. 3, 4A and 4B, and 5A to 5C.

Figure 3:
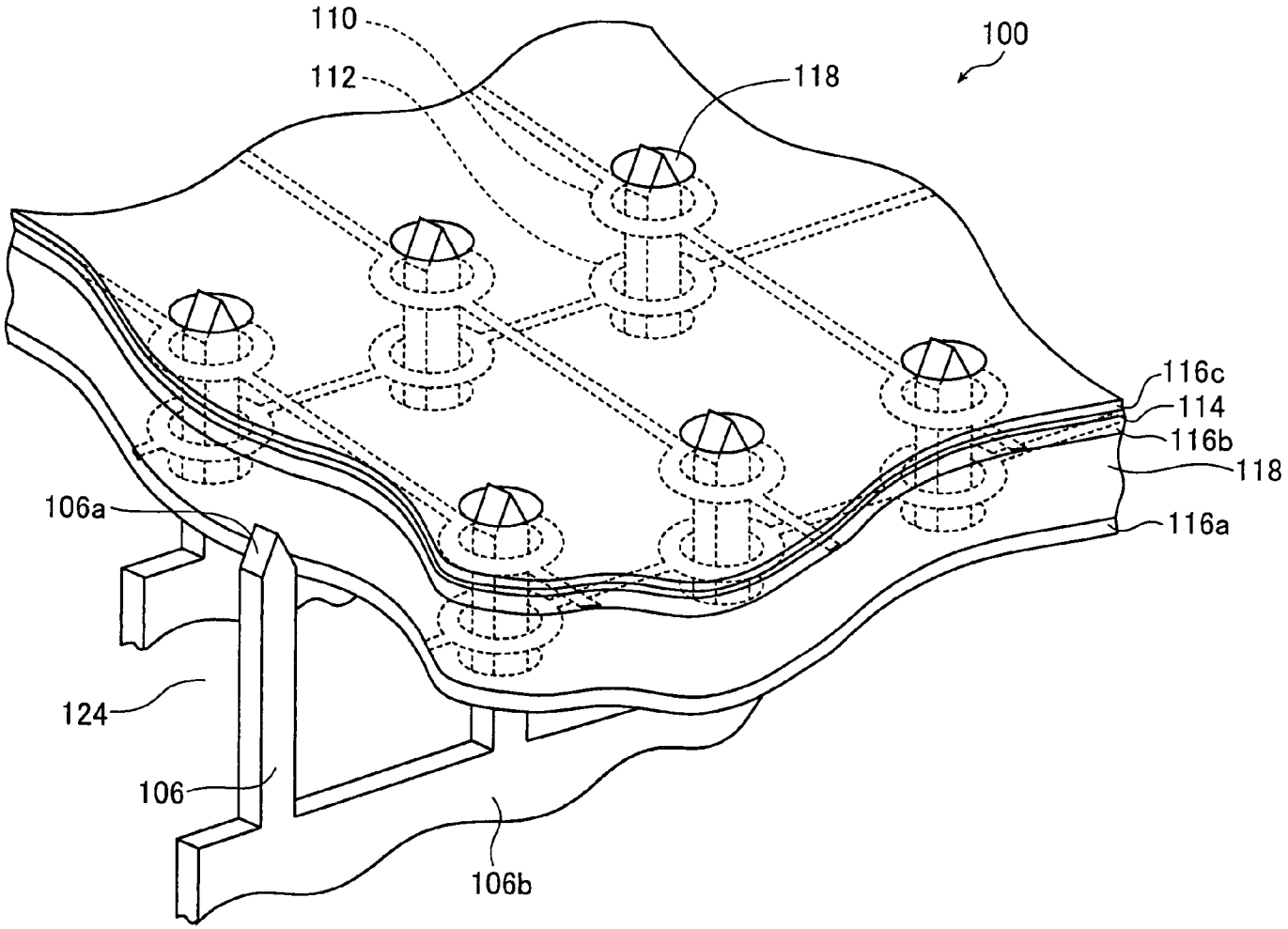
FIG. 3 is a schematic perspective view showing a schematic construction of an electrostatic ink jet head as an embodiment of a recording head shown in FIG. 2.
Figure 4A:
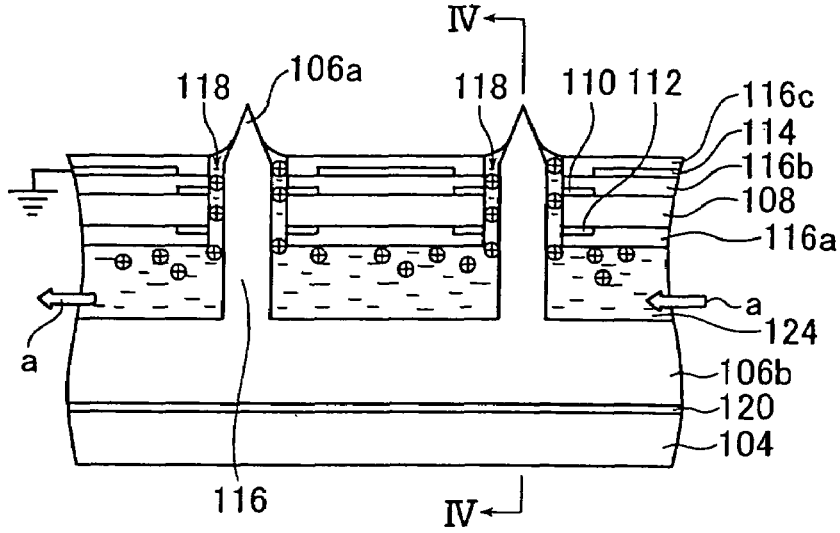
FIGS. 4A and 4B are a schematic cross sectional view showing a schematic construction of the ink jet head shown in FIG. 3, and a cross sectional view taken along the line IV-IV of FIG. 4A.
Figure 4B:
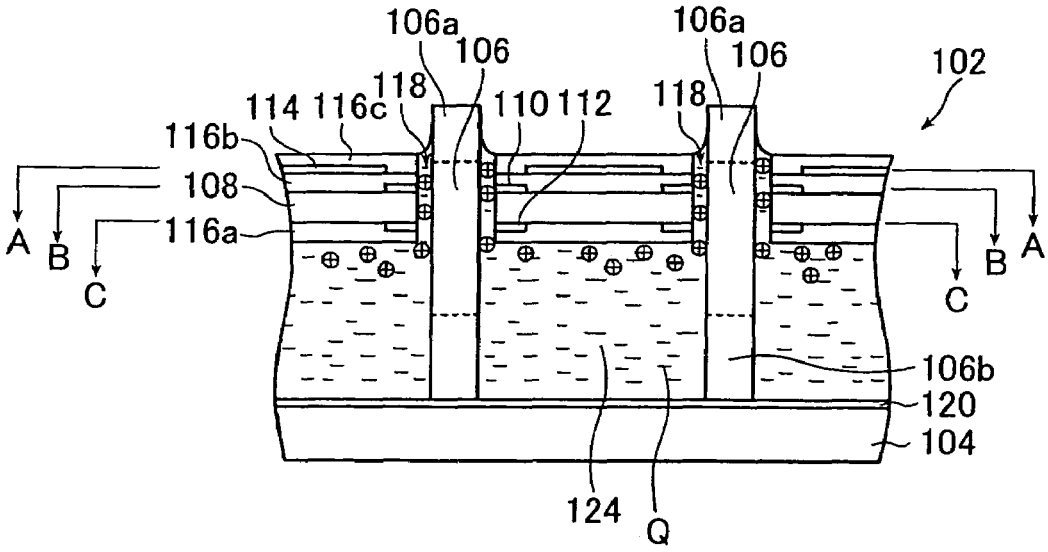
Figure 5A:
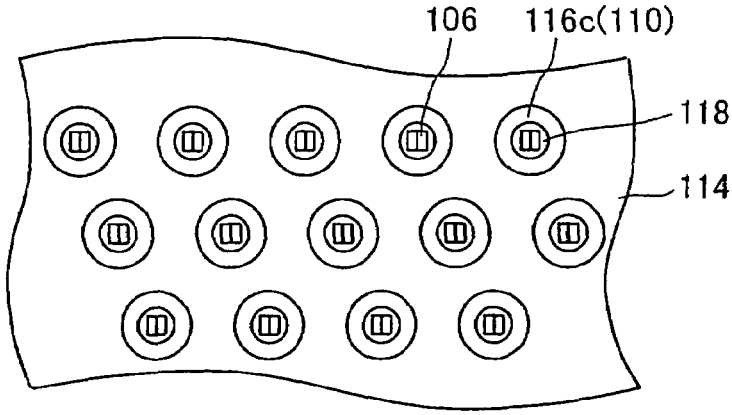
FIGS. 5A, 5B and 5C are a cross sectional view taken along the line A-A of FIG. 4B, a cross sectional view taken along the line B-B of FIG. 4B, and a cross sectional view taken along the line C-C of FIG. 4B.
Figure 5B:
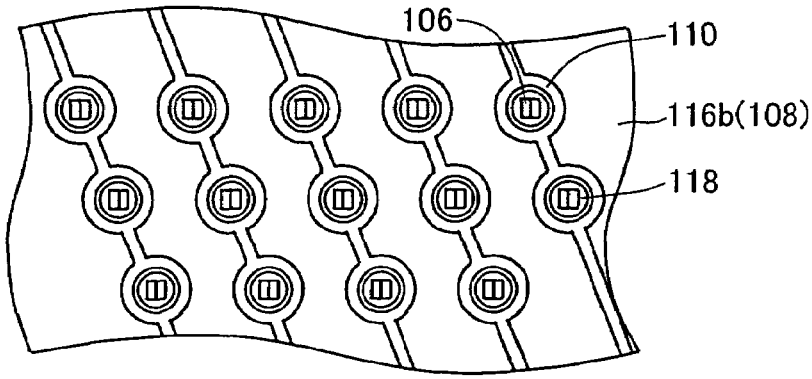
Figure 5C:
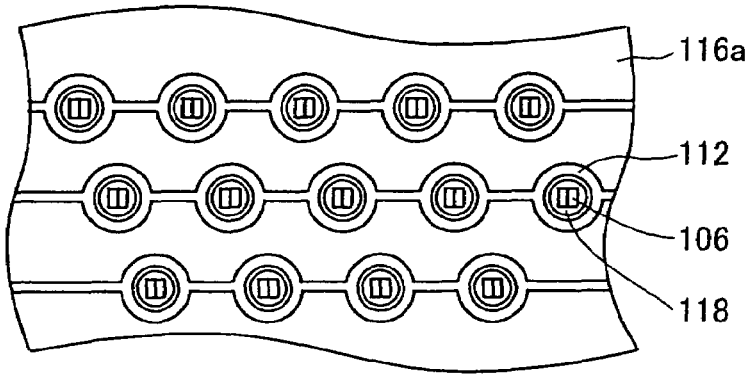

FIG. 3 is a partial perspective view schematically showing a construction of an example of the ink jet head 100 used in the recording head 88 shown in FIG. 2. FIG. 4A is a schematic cross-sectional view showing a part of the ink jet head 100 shown in FIG. 3. FIG. 4B is a schematic cross-sectional view taken along line IV-IV in FIG. 4A. FIGS. 5A, 5B, and 5C are arrow views each taken along the line A-A, the line B-B, and the line C-C in FIG. 4B (through hole portions are viewed from upper side).

The ink jet head 100 shown in these figures is an electrostatic ink jet head having ejection electrodes of a two-layered electrode structure and records an image corresponding to image data on the recording medium P by ejecting ink Q containing colorant particles, such as charged pigments (fine particle component of toner or the like, for instance), by means of an electrostatic force. For this purpose, the ink jet head 100 includes a head substrate 104, ink guides 106, an insulative substrate 108, first ejection electrodes 110 and second ejection electrodes 112 constituting ejection electrodes, and a floating conduction plate 120. The ink jet head 100 having this construction is arranged so as to be opposed to the conveyor belt 38 (see FIG. 1A) that supports the recording medium P and serves as a counter electrode.

In the ink jet head 100 of the illustrated example, the ejection electrodes form a two-layered electrode structure where the insulative substrate 108 is sandwiched between the first ejection electrodes 110 arranged on the upper surface of the insulative substrate 108 and the second ejection electrodes 112 arranged on the lower surface thereof in the figures.

The ink jet head 100 of the illustrated example also includes an insulation layer 116*a* covering the lower side (lower surfaces) of the second ejection electrodes 112, an insulation layer 116*b* covering the upper side (upper surfaces) of the first ejection electrodes 110, a sheet-like guard electrode 114 arranged on the upper side of the first ejection electrodes 110 with the insulation layer 116*b* in-between, and an insulation layer 116*c* covering the upper surface of the guide electrode 114.

In the ink jet head 100 of the illustrate example, each ink guide 106 is made of an insulative resin flat plate having a predetermined thickness and having a projection-like tip end portion 106*a*, and each ink guide 106 is arranged on the head substrate 104 at the position of each ejection portion. Further, in a layered product of the insulation layer 116*a*, the insulative substrate 108, and the insulation layers 116*b* and 116*c*, through holes 118 are established at positions corresponding to the arrangement of the ink guides 106. The ink guides 106 are inserted into the through holes 118 from the insulation layer 116*a* side so that the tip end portions 106*a* of the ink guides 106 project from the insulation layer 116*c*. Note that a slit serving as an ink guide groove may be formed in the tip end portion 106*a* of each ink guide 106 in the top-bottom direction on the paper plane of the figure, thereby promoting supply of the ink Q and concentration of the colorant particles in the ink Q to the tip end portion 106*a*.

The tip end portion 106*a* of each ink guide 106 is formed in an approximately triangular shape (or an approximately trapezoidal shape) that is gradually narrowed toward the recording medium P (conveyor belt 38) side. Also, it is preferable that a metal be vapor-deposited on the tip end portion (extreme tip end portion) 106*a* of each ink guide 106 from which the ink Q is to be ejected. Although there occurs no problem even if the metal vapor-deposition is not carried out for the tip end portion 106*a* of the ink guide 106, it is preferable that the metal vapor-deposition be conducted because the effective dielectric constant of the tip end portion 106*a* of the ink guide 106 becomes large as a result of the metal vapor-deposition and there is provided an effect that it becomes easy to generate an intense electric field. Note that the shape of the ink guides 106 is not specifically limited so long as it is possible to concentrate the ink Q (in particular, the colorant particles in the ink Q) in the tip end portions 106*a* through the through holes 118 of the insulative substrate 108. For instance, the shape of the tip end portions 106*a* may be changed as appropriate into a shape other than the projection, such as a conventionally known shape.

The head substrate 104 and the insulation layer 116*a* are arranged so as to be spaced apart from each other by a predetermined distance, and an ink flow path 124 functioning as an ink reservoir (ink chamber) for supplying the ink Q to the ink guides 106 is formed between the head substrate 104 and the insulation layer 116*a*. Note that the ink Q in the ink flow path 124 contains colorant particles charged to the same polarity as the voltages applied to the first ejection electrodes 110 and the second ejection electrodes 112, and is circulated in a predetermined direction (in the example shown in FIG. 4A, in the direction of an arrow "a" from the right to the left) in the ink flow path 124 at a predetermined speed. (ink flow of 200 mm/s, for instance) by the ink circulation system 58 (see FIG. 1A) at the time of recording. Hereinafter, a case where the colorant particles in the ink are positively charged will be described as an example.

As shown in FIG. 3, the first ejection electrodes 110 and the second ejection electrodes 112 are arranged in a ring shape on the upper surface of the insulative substrate 108 (on the recording medium P side) and the lower surface thereof (on the head substrate 104 side), respectively, and they are circular electrodes surrounding the through holes 118 bored in the insulative substrate 108. Note that the first ejection electrodes 110 and the second ejection electrodes 112 are not limited to the circular electrodes and may be changed into approximately circular electrodes, division-circular electrodes, parallel electrodes, or approximately parallel electrodes. The first ejection electrodes 110 and the second ejection electrodes 112, a part of which have the shape described above, are arranged in a matrix shape and form the two-layered electrode structure. Here, the multiple first ejection electrodes 110 are connected to each other in a row direction (main scanning direction, for instance) and the multiple second ejection electrodes 112 are connected to each other in a column direction (sub scanning direction, for instance).

When the first ejection electrodes 110 in one row are set at a high-voltage level or under a floating (high-impedance) state and the second ejection electrodes 112 in one column are set at a high-voltage level, that is, when both of one row and one column of the electrodes are set under an on-state, one ejection portion existing at an intersection of the row and the column is set under an on-state and ejects the ink. Note that ink ejection is not performed when one of the first ejection electrodes 110 and the second ejection electrodes 112 are set at a ground level. In this manner, the first ejection electrodes 110 and the second ejection electrodes 112 arranged in a matrix manner are matrix-driven.

Meanwhile, the recording medium P charged to a voltage having a polarity that is opposite to the polarity of the charged colorant particles in the ink is arranged so as to be opposed to the ink guides 106 while being held on the conveyor belt 38. As described above, in this embodiment, the recording medium P is charged to a negative high voltage. Also, the front surface of the conveyor belt 32 holding the recording medium P is an insulative fluororesin surface and the back surface thereof is a conductive metallic surface, with the metallic surface being grounded through the conductive roller 40*b* (see FIG. 1A).

The floating conduction plate 120 is arranged below the ink flow path 124 and is set under an electrically insulated state (high-impedance state). In the illustrated example, the floating conduction plate 120 is arranged on the upper surface of the head substrate 104.

At the time of recording of an image, the floating conduction plate 120 generates an induced voltage in accordance with the value of a voltage applied to each ejection portion and causes the colorant particles in the ink Q in the ink flow path 124 to migrate to the insulative substrate 108 side and to be concentrated in the ink Q. Accordingly, it is required that the floating conduction plate 120 is arranged on the head substrate 104 side with respect to the ink flow path 124. Also, it is preferable that the floating conduction plate 120 be arranged on an upstream side of the ink flow path 124 with respect to the position of the ejection portion. With this floating conduction plate 120, the concentration of the colorant particles in the upper layer in the ink flow path 124 is increased. As a result, it becomes possible to increase the concentration of the colorant particles in the ink Q passing through the through holes 118 to a predetermined level, to cause the colorant particles to be concentrated in the tip end portions 106*a* of the ink guides 106, and to maintain the concentration of the colorant particles in the ink Q ejected as ink droplets at a predetermined level.

In the ink jet head 100 of this embodiment including the ejection electrodes of the two-layered electrode structure described above, the second ejection electrodes 112 always receive application of a predetermined voltage (600 V, for instance) and the first ejection electrodes 110 are switched between a ground state (off-state) and a high-impedance state (on-state) in accordance with image data, for instance. By doing so, ejection/non-ejection of the ink Q containing the colorant particles charged to the same polarity as that of the high-voltage applied to the second ejection electrodes 112 is controlled. That is, in the ink jet head 100, when one of the first ejection electrodes 110 is set at the ground level (off-state), the electric field strength in the vicinity of the tip end portion 106*a* of a corresponding ink guide 106 remains low and ejection of the ink Q from the tip end portion 106*a* of the ink guide 106 is not performed. On the other hand, when one of the first ejection electrodes 110 is set under the high-impedance state (on-state), the electric field strength in the vicinity of the tip end portion 106*a* of the corresponding ink guide 106 is increased and the ink Q concentrated in the tip end portion 106*a* of the ink guide 106 is ejected from the tip end portion 106*a* by means of an electrostatic force. When doing so, it is also possible to further concentrate the ink Q by selecting the condition.

In such a two-layered electrode structure, the first ejection electrodes 110 are switched between the high-impedance state and the ground level, so that no large electric power is consumed for the switching. Therefore, according to this embodiment, even in the case of an ink jet head that needs to perform high-definition recording at a high speed, it becomes possible to significantly reduce power consumption.

It should be noted here that the ejection/non-ejection may be controlled by switching the first ejection electrodes 110 between the ground level (off-state) and the high-voltage level (on-state) in accordance with image data. In the ink jet head 100 of this embodiment, when one of the first ejection electrodes 110 and the second ejection electrodes 112 are set at the ground level, the ink ejection is not performed and, only when the first ejection electrodes 110 are set under the high-impedance state or at the high-voltage level and the second ejection electrodes 112 are set at the high-voltage level, the ink ejection is performed.

Also, in this embodiment, pulse voltages may be applied to the first ejection electrodes 110 and the second ejection electrodes 112 in accordance with image signals and the ink ejection may be performed when both of these electrodes are set at the high-voltage level.

It should be noted here that it does not matter whether the ink ejection/non-ejection is controlled using one or both of the first ejection electrodes 110 and the second ejection electrodes 112. However, it is preferable that when one of the first ejection electrodes 110 and the second ejection electrodes 112 are set at the ground level, the ejection of the ink Q is not performed and, only when the first ejection electrodes 110 are set under the high-impedance state or at the high-voltage level and the second ejection electrodes 112 are set at the high-voltage level, the ink ejection is performed.

Also, the recording medium P may be charged to −1.5 kV, for instance, and the ink ejection may be controlled so that the ink will not be ejected when at least one of the first ejection electrodes 110 and the second ejection electrodes 112 are set at a negative high voltage (−600 V, for instance) and the ink will be ejected only when both of the first ejection electrodes 110 and the second ejection electrodes 112 are set at the ground level (0V).

Also, according to this embodiment, the ejection portions are arranged in a two-dimensional manner and are matrix-driven, so that it becomes possible to significantly reduce the number of row drivers for driving multiple ejection electrodes in the row direction and the number of column drivers for driving multiple ejection electrodes in the column direction. Therefore, according to this embodiment, it becomes possible to significantly reduce the implementation area and power consumption of a circuit for driving the two-dimensionally arranged ejection portions. Also, according to this embodiment, it is possible to arrange the ejection portions while maintaining relatively large margins, so that it becomes possible to extremely reduce a danger of discharging between the ejection portions and to cope with both of high-density implementation and high voltage driving with safety.

It should be noted here that in the case of an ink jet head, such as the electrostatic ink jet head 100 described above, that uses ejection electrodes of the two-layered electrode structure composed of the first ejection electrodes 110 and the second ejection electrodes 112, when the ejection portions are arranged at a high density, an electric field interference may occur between adjacent ejection portions. Therefore, it is preferable that, like in this embodiment, the guard electrode 114 be provided between the first ejection electrodes 110 of adjacent ejection portions so that the guard electrode 14 may shield the ink guides 106 from the electric lines of force to the adjacent ink guides 106.

The guard electrode 114 is arranged in spaces between the first ejection electrodes 110 of adjacent ejection portions and suppresses the electric field interferences generated between the ink guides 106 of the adjacent ejection portions. FIGS. 5A, 5B, and 5C are respectively arrow views taken along the lines A-A, B-B, and C-C in FIG. 4B. As shown in FIG. 5A, the guard electrode 114 is a sheet-like electrode such as a metal plate that is common to every ejection portion, and holes are bored in the guard electrode 114 in portions corresponding to the first ejection electrodes 110 (respective ejection portions two-dimensionally arranged) formed around the through holes 118 (also see FIG. 3). Note that in this embodiment, the reason why the guard electrode 114 is provided is that if the ejection portions are arranged at a high density, there is a case where an electric field generated by an ejection portion is influenced by the states of electric fields generated by its adjacent ejection portions and therefore the size and drawing position of a dot ejected from the ejection portion fluctuate and recording quality is adversely affected.

By the way, the upper side of the guard electrode 114 shown in FIGS. 4A and 4B is covered with the insulation layer 116*c* except the through holes 118 and the insulation layer 116*b* is disposed between the guard electrode 114 and the first ejection electrodes 110, thereby insulating the electrodes 114 and 110 from each other. That is, the guard electrode 114 is arranged between the insulation layer 116*c* and the insulation layer 116*b* and the first ejection electrodes 110 are arranged between the insulation layer 116*b* and the insulative substrate 108.

That is, as shown in FIG. 5B, on the upper surface of the insulative substrate 108, that is, between the insulation layer 116*b* and the insulative substrate 108, the first ejection electrodes 110 of the respective ejection portions formed around the through holes 118 are two-dimensionally arranged and are connected to each other in the column direction.

Also, as shown in FIG. 5C, on the upper surface of the insulation layer 116*a* (that is, on the lower surface of the insulative substrate 108), that is, between the insulation layer 116*a* and the insulative substrate 108 (see FIG. 3), the second ejection electrodes 112 of the respective ejection portions formed around the through holes 118 are two-dimensionally arranged and are connected to each other in the row direction.

Also, in this embodiment, in order to shield from a repulsive electric field from the ejection electrode of each ejection portion (a repulsive electric field from each first ejection electrode 110 and each second ejection electrode 112) toward the ink flow path 124, a shield electrode may be provided on the flow path side of the second ejection electrode 112.

Further, in the ink jet head 100 of this embodiment, the floating conduction plate 120 is provided which constitutes the undersurface of the ink flow path 124 and causes the positively charged colorant particles (charged colorant particles) in the ink flow path 124 to migrate upwardly (that is, toward the recording medium P side) by means of induced voltages generated by pulse voltages applied to the first ejection electrodes 110 and the second ejection electrodes 112. Also, an electrically insulative coating film (not shown) is formed on a surface of the floating conduction plate 120, thereby preventing a situation where the physical properties and components of the ink are destabilized due to charge injection into the ink or the like. It is preferable that the electric resistance of the insulative coating film be set at $10^{12}$ Ω·cm or higher, more preferably at $10^{13}$ Ω·cm or higher. Also, it is preferable that the insulative coating film be corrosion resistant to the ink, thereby preventing a situation where the floating conduction plate 120 is corroded by the ink. Further, the floating conduction plate 120 is covered with an insulation member from its bottom side. With this construction, the floating conduction plate 120 is completely electrically insulated and floated.

Here, at least one floating conduction plate 120 is provided for each unit of the ink jet head. A monochrome ink jet head is used in this embodiment, but when four ink jet heads are used for C, M, Y, and K, each head is provided with at least one floating conduction plate 120 and the ejection heads for C and M will never share the same floating conduction plate.

In this embodiment, the circular electrodes are provided as the first ejection electrodes 110 and the second ejection electrodes 112 of the respective ejection portions and these electrodes are connected to each other in the row direction and the column direction. However, the present invention is not limited to this and all of the ejection portions may be separated from each other and driven independently of each other. Alternatively, one of the first ejection electrodes 110 and the second ejection electrodes 112 may be set as a sheet-like electrode common to every ejection portion (holes are bored in portions corresponding to the through holes 118).

Also, in this embodiment, the ejection electrodes are arranged so as to form the two-layered electrode structure composed of the first ejection electrodes 110 and the second ejection electrodes 112. However, the present invention is not limited to this and the ejection electrodes may be arranged so as to form a mono-layered electrode structure. In the case of the mono-layered electrode structure, it does not matter on which surface of the insulative substrate 108 the ejection electrodes are arranged, although it is preferable that the ejection electrodes be provided on the recording medium P side thereof. The ink jet head is constructed as described above.

In addition, as described above, there is carried out the serial scanning in which it is repeated that the ink is ejected while the main scanning with the recording head 88 is carried out in the direction perpendicular to the direction of conveyance of the recording medium P, and the recording medium P is then conveyed by a fixed amount. Hence, the ejection portions of the ink jet head 100 are preferably disposed in a direction nearly parallel to the direction of conveyance of the recording medium P.

In addition, preferably, the ejection portions of the ink jet head 100 are disposed so as to be opposed to the surface of the conveyor belt 38 (see FIG. 1A) in a position where the conductive platen 42 is disposed and the ejection portions are at a predetermined distance away from the surface of the recording medium P which is conveyed with the recording medium P being electrostatically attracted to the conveyor belt 38.

As described above, the surface of the recording medium P which is electrostatically attracted to the conveyor belt 38 acting as the counter electrode is uniformly charged to a predetermined negative high potential by the charger 44 for the recording medium P, and hence is in a state in which a constant D.C. bias voltage (about −1.5 kV) is usually applied thereto. In addition, in recording of an image, the pulse voltages corresponding to the image data are applied to the first and second ejection electrodes 110 and 112 of each of the ejection portions of the ink jet head 100 by a pulse voltage applying device (not shown) for application of pulse voltages to the ink jet head 100.

When the high voltages (400 to 600 V) are applied as the pulse voltages to the first and second ejection electrodes 110 and 112 of each of the ejection portions of the ink jet head 100, respectively, in a state in which the constant D.C. bias voltage (about −1.5 kV) is applied to the surface of the recording medium P, the ink is ejected, while when the low voltages (0 V) are applied as the pulse voltages to the first and second ejection electrodes 110 and 112 of each of the ejection portions of the ink jet head 100, respectively, no ink is ejected in that state. The ink ejected from the ink jet head 100 is attracted towards the surface of the recording medium P having the bias voltage applied thereto to be adhered to the surface of the recording medium P, thereby recording a monochrome image corresponding to the image data on the surface of the recording medium P.

Note that, in this embodiment, the constant D.C. bias voltage is usually applied to the surface of the recording medium P which is electrostatically attracted to the conveyor belt 38 acting as the counter electrode, and in recording of an image, the pulse voltages corresponding to the image data are applied to the first and second ejection electrodes 110 and 112, respectively. However, it may also be adapted that the counter electrode side is grounded, and in this state, a constant D.C. bias voltage (e.g., 1.5 kV) is usually applied to the side of the first and second ejection electrodes 110 and 112 of each of the ejection portions of the ink jet head 100 by a D.C. bias voltage applying device (not shown) for application of a bias voltage to the ink jet head 100.

As described above, ink Q (ink composition) used in the present invention is obtained by dispersing colorant particles (charged fine particles which contain colorants) in a carrier liquid.

In addition, dispersion resin particles for enhancement of the fixing property of an image after completion of the printing may be contained together with the colorant particles in the ink Q.

The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistance of the carrier liquid is low, the concentration of the colorant particles does not occur since the carrier liquid itself receives the injection of the electric charges to be charged due to a voltage applied from ejection electrodes. In addition, since there is also anxiety that the carrier liquid having a low electrical resistivity causes the electrical conduction between the adjacent ejection portions, the carrier liquid having a low electrical resistivity is unsuitable for the present invention.

A relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that an upper limit of the specific electrical resistance of such a dielectric liquid is desirably about $10^{16}$ Ω·cm, and a lower limit of the relative permittivity is desirably about 1.9. The reason why the electrical resistance of the dielectric liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as a carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid. Alternatively, the colorant particles may also be contained in dispersion resin particles for enhancement of fixing property. In the case where the colorants are contained in the dispersion resin particles, in general, there is adopted a method in which the pigments or the like are covered with the resin material of the dispersion resin particles to obtain the particles covered with the resin, and the dispersion resin particles are colored with the dyes or the like to obtain the colored particles.

As the colorants, all the ink composition for ink jet recording, the (oily) ink composition for printing, or the pigments and dyes used in the liquid developer for electrostatic photography may be used as in the past.

In the ink, a content of colorant particles (a total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink and the surface of the recording medium P becomes difficult to be obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink is easy to occur in the ink jet head 100 or the like to make it difficult to obtain the stable ink ejection, and so forth. The reason why the above-mentioned range is selected for the content of colorant particles is to prevent those problems from arising.

In this embodiment, a monochrome image is recorded using a monochrome ink jet head for K (black). However, there is no particular limitation on the color used and the colorants in the respective colors as described below can be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

In addition, an average particle diameter of the colorant particles dispersed in the carrier liquid preferably falls with in a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles are dispersed in the carrier liquid, a charging control agent is added to the resultant carrier liquid to charge the colorant particles, and the charged colorant particles are dispersed in the resultant liquid to thereby produce the ink. Note that in dispersing the colored fine particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, a charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where $\alpha 1$ is an electric conductivity of the ink, and $\sigma 2$ is an electric conductivity of a supernatant liquid which is obtained by inspecting the ink with a centrifugal separator. Those electric conductivities were obtained by measuring the electric conductivities of the ink and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink as described above is used, which results in that the colorant particles are likely to migrate and hence the colorant particles are easily concentrated.

The electric conductivity of the ink is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, a surface tension of the ink is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, a viscosity of the ink is preferably in a range of 0.5 to 5.0 mPa·sec, more preferably in a range of 0.6 to 3.0 mPa·sec, and much more preferably in a range of 0.7 to 2.0 mPa·sec.

Note that, in the present invention, there is not adopted the process in which a force is caused to act on the overall ink to fly the ink towards the recording medium as in a conventional ink jet system, but there is adopted the process in which a force is caused to mainly act on the colorant particles as the solid components dispersed into the carrier liquid to fly the ink droplets each containing the colorant particles to the recording medium P.

As a result, an image can be recorded on various recording media such as a non-absorption film (such as a PET film) as well as plain paper. In addition, a high-quality image can be obtained on the various recording media without causing bleeding or flowing on the recording medium P.

An operation of ejection of ink droplets in the ink jet head 100 will be described below.

As described above, the surface of the recording medium P which is electrostatically attracted to the conveyor belt 38 acting as the counter electrode is uniformly charged to a predetermined negative high potential by the charger 44 for the recording medium P, and hence is in a state in which a constant bias voltage (about −1.5 kV) is usually applied thereto. Note that the ink Q is caused to circulate at a predetermined velocity in a direction indicated by an arrow a in FIG. 8 through the ink flow path 124.

In a state in which only the bias voltage is applied to the surface of the recording medium P, the Coulomb attraction between the bias voltage and the electric charges of the colorant particles of the ink, the Coulomb repulsion among the colorant particles, the viscosity of the carrier liquid, the surface tension, the dielectric polarization force and the like act on the ink, and these factors operate in conjunction with one another to move the charged colorant particles and the carrier liquid. Thus, the ink shows the meniscus shape in which the ink slightly rises from the through hole 118, thereby obtaining the balance.

In addition, the colorant particles are moved towards the recording medium P charged to the bias voltage through a so-called electrophoresis process by the Coulomb attraction and the like. That is, the ink is condensed at the meniscus of the through hole 118.

Under this state, pulse voltages used to eject the ink droplets are applied (ejection is valid (ON)). That is, in the illustrated example, the pulse voltages each falling within a range of about 100 to about 600 V are applied from the corresponding pulse power supplies to the first and second ejection electrodes 110 and 112, respectively, to drive the first and second ejection electrodes 110 and 112, thereby ejecting the ink droplets.

As a result, the pulse voltages are superposed on the bias voltage, and hence the motion is caused in which the previous conjunction motion operates in conjunction with the superposition of the pulse voltages. Thus, the colorant particles and the carrier liquid are drawn towards the bias voltage side (counter electrode side), i.e., the recording medium P side through the electrophoresis process to form a so-called Taylor cone. In addition, similarly to the foregoing, the colorant particles are moved to the meniscus through the electrophoresis process so that the ink at the meniscus is condensed to show a nearly uniform high concentration state in which the ink at the meniscus has a large number of colorant particles.

When a finite time further elapses after start of application of the pulse voltages to the first and second ejection electrodes 110 and 112, the balance mainly between the coulomb attraction acting on the colorant particles and the surface tension of the carrier liquid is broken at the tip portion of the meniscus having the high electric field strength applied thereto due to the movement of the colorant particles or the like. As a result, the meniscus abruptly grows to form a slender ink liquid column called a thread.

When a finite time further elapses, the formed thread is divided into parts due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets and is drawn by the bias voltage as well to be adhered to the recording medium P.

The growth and division of the thread, and moreover the movement of the colorant particles to the meniscus (formed thread) are continuously generated while the pulse voltages are applied to the first and second ejection electrodes 110 and 112, respectively. That is, while the thread is formed, the ink droplets are intermittently flown towards the recording medium P. In addition, at a time point when the application of the pulse voltages to the first and second ejection electrodes 110 and 112 is completed (ejection is invalid (OFF)), the force for drawing the colorant particles and the carrier liquid towards the recording medium P side become weak, and hence the formed thread becomes small. Thus, after a predetermined time elapses, the state of the ink is returned back to the state of the meniscus in which only the bias voltage is applied to the surface of the recording medium P.

In the ink jet head 100, when the pulse voltages (drive voltages) are applied to the first and second ejection electrodes 110 and 112, respectively, as described above, the thread is formed and is then divided into parts, whereby the ink droplets are ejected and a part of an image for one dot is formed by a large number of fine ink droplets.

The ink jet head 100 as described above is used, and the ejection of the ink droplets from the ink jet head 100 is controlled by the head driver 56 in accordance with the image data while the serial scanning is carried out as described above, thereby forming a monochrome image.

Note that, in this embodiment, the constant D.C. bias voltage is usually applied to the surface of the recording medium P which is electrostatically attracted to the conveyor belt acting as the counter electrode, and in recording of an image, the pulse voltages corresponding to the image data are applied to the first and second ejection electrodes 110 and 112, respectively. However, it may also be adopted that the counter electrode side is grounded, and a constant D.C. bias voltage (e.g., −1.5 kV) is usually applied to the side of the first and second ejection electrodes 110 and 112 of each of the ejection portions of the ink jet head 100 by the D.C. bias voltage applying device (not shown) for application of the bias voltage to the ink jet head 100.

Referring back to FIG. 1A, the description of the recording means 16 will be continued.

The head driver 56 is installed inside the casing 24 on its right-hand side in FIG. 1A, and is connected to the recording head 88 of the head unit 54.

The image data from an external device as well as the positional information of the recording medium P from the position detector 60 are inputted to the head driver 56. The ink is ejected from the ejection head based on image data while the ejection timing of the ink jet head 100 of the recording head 88 to be described below (FIGS. 3-8) is controlled based on the positional information of the recording medium P with the control made by the head driver 56. Thus, a monochrome image corresponding to the image data is recorded on the recording medium P.

The position detector 60 for detecting a position of the recording medium P is conventionally known position detection means composed of a photo-sensor or the like. The position detector 60 is disposed in a position between the charger 44 and the ink jet head 54 along the conveyance path for the recording medium P. In this case, the position detector 60 is disposed in a position where the detector 60 is opposed to the surface of the conveyor belt 38 on which the recording medium P is conveyed.

A position of the recording medium P is detected by the position detector 60, and the resultant positional information is supplied to the head driver 56.

The ink circulation system 58 includes the ink tank 61, a pump (not shown), the ink supply passage 62 and the ink recovery passage 64.

The ink tank 61 is disposed inside the casing 24 on its bottom surface, and is connected to the head unit 54 through the ink supply passage 62 and the ink recovery passage 64.

The ink containing the colorant particles is collected in the ink tank 61. The ink collected in the ink tank 61 is supplied to the head unit 54 through the ink supply passage 62 by the pump. The ink which is not used in recording of an image is recovered into the ink tank 61 through the ink recovery passage 64.

In addition, a temperature control unit for controlling a temperature of the ink to be ejected in the form of the ink droplet to suppress any of changes in temperature of the ink may be mounted on the ink tank 61.

Any known temperature control unit can be used for the ink temperature control unit. Examples thereof are a unit which includes a temperature control element or means such as a heating element or means (e.g., heater) and/or a heating/heat absorbing element (e.g., Pertier element) and/or cooling means (e.g., cooler) as well as a controller and a temperature sensor for the temperature control element or means, and which controls the temperature control element or means as described above by the controller in accordance with the ink concentration detected by the temperature sensor; and a unit which controls the temperature control element or means for example by a thermostat in which the temperature sensor is integrated with the controller. In addition, the temperature control unit may be disposed anywhere as long as the temperature of the ink to be ejected in the form of the ink droplets can be adjusted and the ink tank 61 is not the sole place where the temperature control unit is disposed. For example, the temperature control unit may be disposed in the head unit 54, an ink piping system or the like.

The ink tank 61 may also be further provided with stirring means for suppressing precipitation and concentration of the solid components contained in the ink. As the stirring means, for example, a rotary blade, an ultrasonic transducer, a circulation pump or the like may be used.

Subsequently, the solvent collection means 18 will be described.

The solvent collection means 18 collects the dispersion solvent evaporating from the ink ejected from the recording head 88 onto the recording medium P, the dispersion solvent evaporating from the ink during image fixation, and the like. The solvent collection means 18 includes an exhaust fan 66 and an activated carbon filter 68. The activated carbon filter 68 is mounted on an upper rear surface of the casing 24, and the exhaust fan 66 is mounted onto the activated carbon filter 68.

The air containing the dispersion solvent components in the casing 24 is exhausted to the outside of the casing 24 through the activated carbon filter 68 by the exhaust fan 66. During the exhaust of the air, the dispersion solvent components contained in the air in the casing 24 are attracted and removed by the activated carbon filter 68.

The ink concentration detecting means 20 as a characteristic portion of the present invention will hereinafter be described in detail.

The ink concentration detecting means 20 includes a detection portion 70, a bias electrode 72, and an arithmetic operation portion 74.

As shown in FIG. 1B, the bias electrode 72 is disposed in a position in which the bias electrode 72 faces the head unit 54 and is adjacent to the conveyor belt 38.

In addition, while details will be described later, a support member 82 of the head unit 54 can be moved in a direction (in a vertical direction in FIG. 1B) intersecting perpendicularly the direction of movement of the conveyor belt 38 along guide rails 84*a* and 84*b* (refer to FIG. 2) by drive means 86. Thus, the recording head 88 provided in the support member 82 can move to a position where the head 88 faces the bias electrode 72.

The detection portion 70 is disposed between the bias electrode 72 and the head unit 54.

Figure 6:
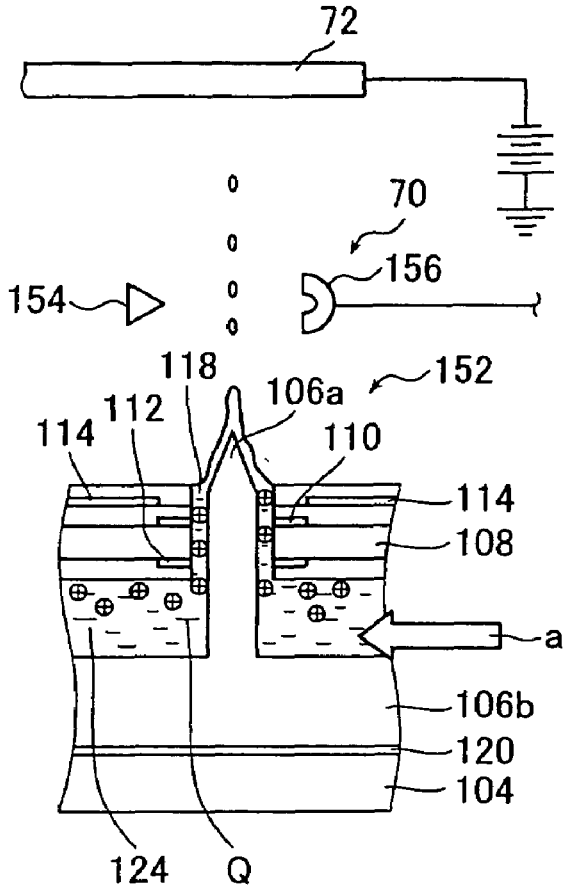
FIG. 6 is an enlarged schematic view showing a periphery of a detection portion shown in FIG. 1.

The detection portion 70 will hereinafter be described with reference to FIG. 6. Here, FIG. 6 is a schematic view showing a state in which the recording head 88 (ink jet head 100) moves to a position where the head 88 faces the bias electrode 72.

The bias electrode 72 is connected to a constant voltage source for applying a constant voltage (about −1.5 kV) thereto. In addition, as described above, the ink jet head 100 including ejection portions 152 is disposed in the position where the head 100 faces the bias electrode 72.

Here, when the constant voltage (about −1.5 kV) is applied from the constant voltage source to the bias electrode 72, the meniscus is formed in the through hole 118 of one ejection portion 152 of the ink jet head 100 by conjunction of the forces to provide a state in which the ink Q is condensed.

When predetermined voltages (about 100 to about 600 V) are applied to the first and second ejection electrodes 110 and 112 of the ejection portion 152 in this state, respectively, a predetermined electric field allowing the ink droplets to be ejected from the ejection portion 152 is formed so that the meniscus grows to form a Taylor cone. Thereafter, the thread is formed, and the growth and division of the thread are then caused. The thread thus divided passes in the form of the ink droplets along a predetermined path (flight path) to be adhered to the bias electrode 72. The growth and division of the thread and the movement of the colorant particles to the meniscus are continuously generated while the electric field allowing the ink droplets to be ejected from the ejection portion 152 is formed.

Here, when the ejection of the ink droplets is detected by the detection portion 70, the electric field formed in the ejection portion 152 is preferably constant. Hence, the voltages which are applied to the first and second ejection electrodes 110 and 112, and the bias electrode 72, respectively, are preferably constant.

The detection portion 70 includes a light emitting element (photo transmitter) 154 and a light receiving element (photoreceptor) 156, and is disposed between the recording head 88 (the ink jet head 100) and the bias electrode 72. The light emitting element 154 and the light receiving element 156 are disposed at a predetermined distance away from each other so as to sandwich the flight path of the ink droplets ejected from the above-mentioned ejection portion 152.

The light emitting element 154 emits light of a fixed quantity of light to the light receiving element 156, and the light receiving element 156 measures a quantity of light received thereat to output an output signal corresponding to the quantity of measured light to the arithmetic operation portion 74.

Here, the ink droplet ejected from the ejection portion 152 passes between the light emitting element 154 and the light receiving element 156.

Figure 7:
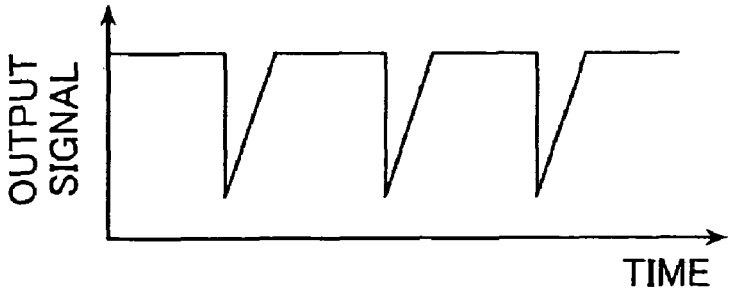
FIG. 7 is a graphical representation showing an example of an output signal detected by the detection portion shown in FIG. 6.

When the ink droplet passes between the light emitting element 154 and the light receiving element 156, the light emitted from the light emitting element 154 is blocked by the ink droplet. Hence, the light receiving element 156 detects a change in quantity of light due to the passing of the ink droplets. Thus, as shown in FIG. 7, whenever the ink droplet passes between the light emitting element 154 and the light receiving element 155, the quantity of light detected by the light receiving element 156 changes.

Referring back to FIG. 1B, the description of the ink concentration detecting means 20 will be continued.

While the ink droplets are ejected, the arithmetic operation portion 74 subjects the output signal transmitted thereto from the light emitting element 156 to predetermined processing such as A/D conversion processing to obtain light quantity data, and calculates ejection timings (ejection state) of the ink droplets based on changes in quantity of light obtained from the resultant light quantity data. Moreover, the arithmetic operation portion 74 calculates an ejection frequency of the ink droplets which are ejected for a predetermined period of time from the ejection of the first ink droplet, or an ejection frequency of the ink droplets for a period of time for the ejection of the predetermined number of ink droplets from the ejection of the first ink droplet.

As described above, since the ejection characteristics change in accordance with the ink concentration, the ejection frequency of ejected ink droplets (hereinafter referred to as "an ejection frequency") changes in accordance with the ink concentration of the ink supplied to the ink jet head 100.

An LUT used to detect the ink concentration, e.g., a weight percentage of the colorant particles contained in the ink Q from the ejection frequency based on a relationship between the ink concentration and the ejection frequency is stored in the arithmetic operation portion 74 of this embodiment.

Such an LUT used to detect the ink concentration from the ejection frequency has to be produced by finding the relationship between the ink concentration and the ejection frequency from the examinations, the simulation and the like which are made in advance. In addition, a transformation equation used to detect the ink concentration from the ejection frequency may be used instead of the LUT.

The arithmetic operation portion 74 detects the ink concentration from the ejection frequency using the LUT to transmit data of the detected ink concentration to the ink concentration adjusting means 22 (an ink concentration adjusting portion 76).

Since the ejection of the ink droplets is measured, the ejection frequency is calculated from the ejection timings, and the ink concentration is calculated from the ejection frequency as described above, the ink concentration can be detected without contacting the ink. Conventionally, the detection portion was contaminated due to contact with the ink, and an error occurred in the detected ink concentration due to the contamination of the detection portion. However, in this embodiment, since such an error can be removed, the ink concentration can be precisely and stably detected for a long term.

Here, the bias electrode 72 is preferably provided with a cleaning mechanism for cleaning the ink droplets adhered thereto. As the cleaning mechanism, any of the conventionally known cleaning devices may be used. The bias electrode 72 is cleaned in this manner, which results in that the ink droplets can be ejected without changing the ejection conditions.

In this embodiment, the predetermined voltages are applied to the bias electrode 72, and the first and second ejection electrodes 110 and 112, respectively, thereby forming the electric field required to eject the ink droplet in the ejection portion. However, the method of forming an electric field is not especially limited. Thus, a predetermined voltage may be applied to only the bias electrode to eject the ink droplets, predetermined voltages may be applied to only the first and second ejection electrodes 110 and 112, respectively, to eject the ink droplets, or electric field forming means for specially forming an electreic field may be provided.

Note that when a predetermined voltage is applied to only the bias electrode to eject the ink droplets, since the ink droplets are ejected from not only the ejection portion 152 the ejection of the ink droplets from which is to be measured, but also other ejection portions, the predetermined voltages are preferably applied to the first and second ejection electrodes 110 and 112 of the ejection portion 152, respectively.

In addition, in this embodiment, the ejection frequency of the ink droplets is calculated from the ejection timings, and the ink concentration is detected from the ejection frequency. However, the present invention is not intended to be limited thereto. Thus, the factors of the ejection state, related to the ink concentration, such as an ejection interval and the number of ejection of the ink droplets have to be detected from the ejection timings to calculate the ink concentration in accordance with the detected factors of the ejection state. In addition, in this case as well, the relationship between the factors of the ejection state and the ink concentration has to be obtained in advance to calculate the ink concentration based on that relationship.

In addition, in this embodiment, the bias electrode 72 is separately provided in the position where the bias electrode 72 faces the ink jet head 100. However, the present invention is not intended to be limited thereto. Thus, in detecting the ink concentration, the measurement portion may be moved to a position between the recording medium P and the head unit 54 in order to measure the ink droplets being ejected towards the recording medium P. Alternatively, the ink droplets being ejected to the conveyor belt 38 may be measured without disposing the recording medium P. In the case where the ink droplets are ejected towards the conveyor belt 38, a cleaning mechanism for cleaning the conveyor belt 38 is preferably provided.

The ink concentration adjusting means 22 includes an ink concentration adjusting portion 76, a conc. solution replenishing portion 78, and a diluted liquid replenishing portion 80.

The ink concentration adjusting portion 76 determines an amount of ink with which the ink tank 61 is to be replenished from the conc. liquid replenishing portion 78 and the diluted liquid replenishing portion 80 in accordance with the ink concentration detected by the ink concentration detecting means 20, a current amount of ink within the ink circulation system, a specified amount of ink which is set in advance, and target ink concentration so that the ink circulation system has the specified amount of the ink in the target concentration.

Here, the method of measuring an amount of ink within the ink circulation system and the head unit 54 is not especially limited. For example, an amount of ejection of the ink may be obtained from the image data or by counting the total number of times of ejection of the ink from all the ejection portions. In addition, an amount of ejection of the ink may be obtained from an amount of evaporation of the ink corresponding to an elapsed time previously measured. Also, since an amount of ink flowing through the ink circulation system except the ink tank 61 should be constant, an amount of ejection of the ink may be obtained by measuring an amount of ink collected in the ink tank 61.

The conc. liquid replenishing portion 78 includes a conc. liquid tank which is filled with the conc. liquid (ink having relatively high ink concentration), and supply means. The supply means supplies the conc. liquid from the conc. liquid tank into the ink tank 61 in accordance with an amount of replenishment of the ink the data of which is transmitted from the ink concentration adjusting portion 76.

In addition, the diluted liquid supplying portion 80 includes a diluted liquid tank which is filled with a diluted liquid (ink having relatively low ink concentration), and supply means. The supply means supplies the diluted liquid from the diluted liquid tank into the ink tank 61 in accordance with an amount of replenishment of the ink the data of which is transmitted from the ink concentration adjusting portion 76.

The ink concentration of the ink flowing through the ink circulation system is thus adjusted in accordance with the precisely detected ink concentration, whereby the ink of suitable ink concentration can be stably supplied to the recording head 88 for a long term. As a result, the ink droplets can be stably ejected, and hence a high-quality image can be stably formed for a long time.

Here, in the electrostatic ink jet recording apparatus of the present invention, since the ink concentration does not abruptly change due to image recording, it is not necessary to always detect the ink concentration during image recording to adjust the ink concentration.

Therefore, according to the ink concentration detection as described above, the ink concentration can be detected for each specified period, for example when the amount of the ink in the ink tank reaches a predetermined level, or when a user perceives a change in ink concentration as a result of his/her visual check of the recorded image, and the ink concentration is adjusted based on the detection results obtained, whereby the ink concentration can be fully kept at a proper level.

While in this embodiment, the ejection state of the ink droplets is detected by the optical means, the present invention is not intended to be limited thereto, and thus the ejection state of the ink droplets may also be detected by electrical means.

Figure 8:
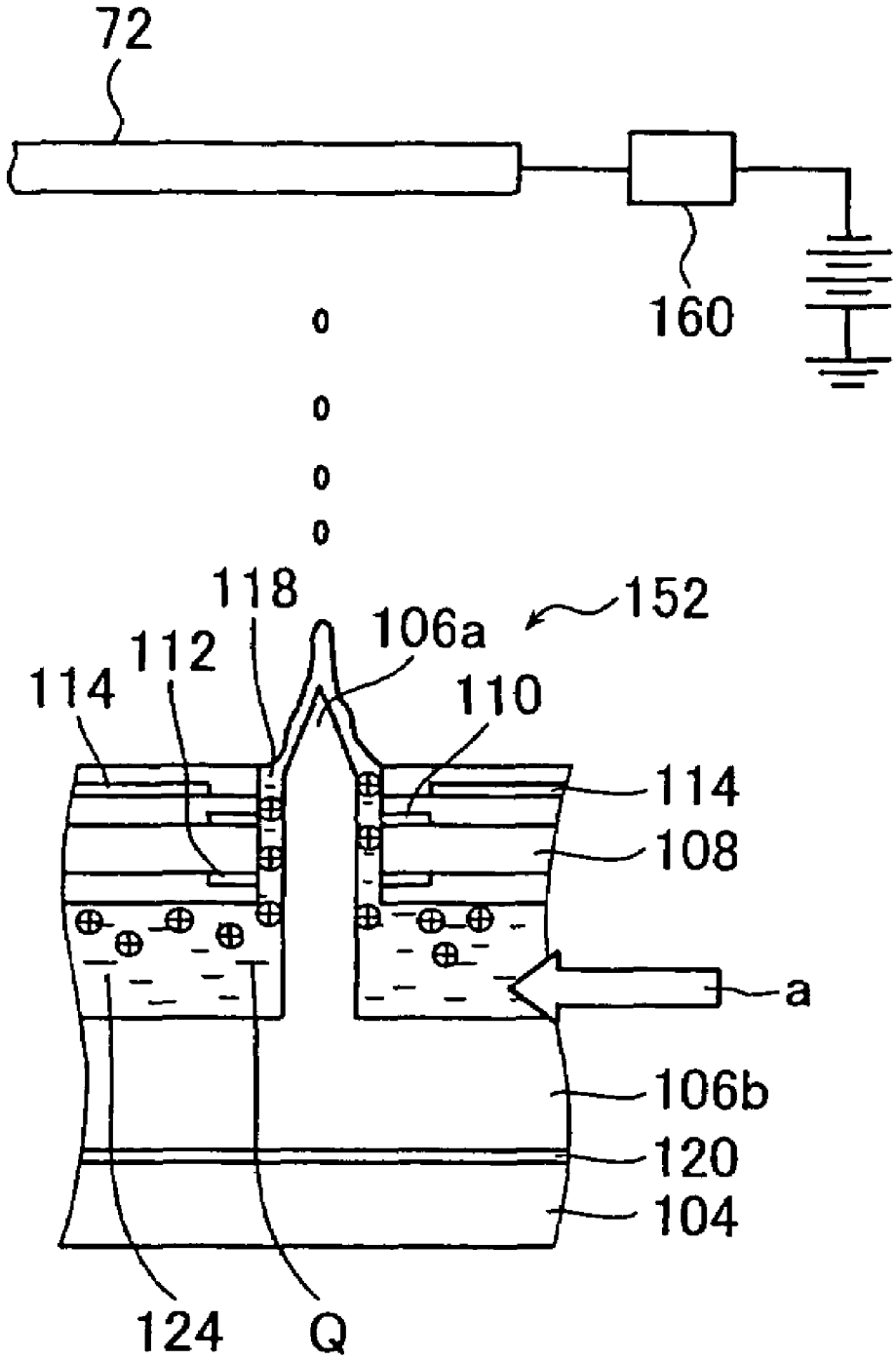
FIG. 8 is an enlarged schematic view showing a construction of the detection portion according to another embodiment of the present invention.
Figure 9:
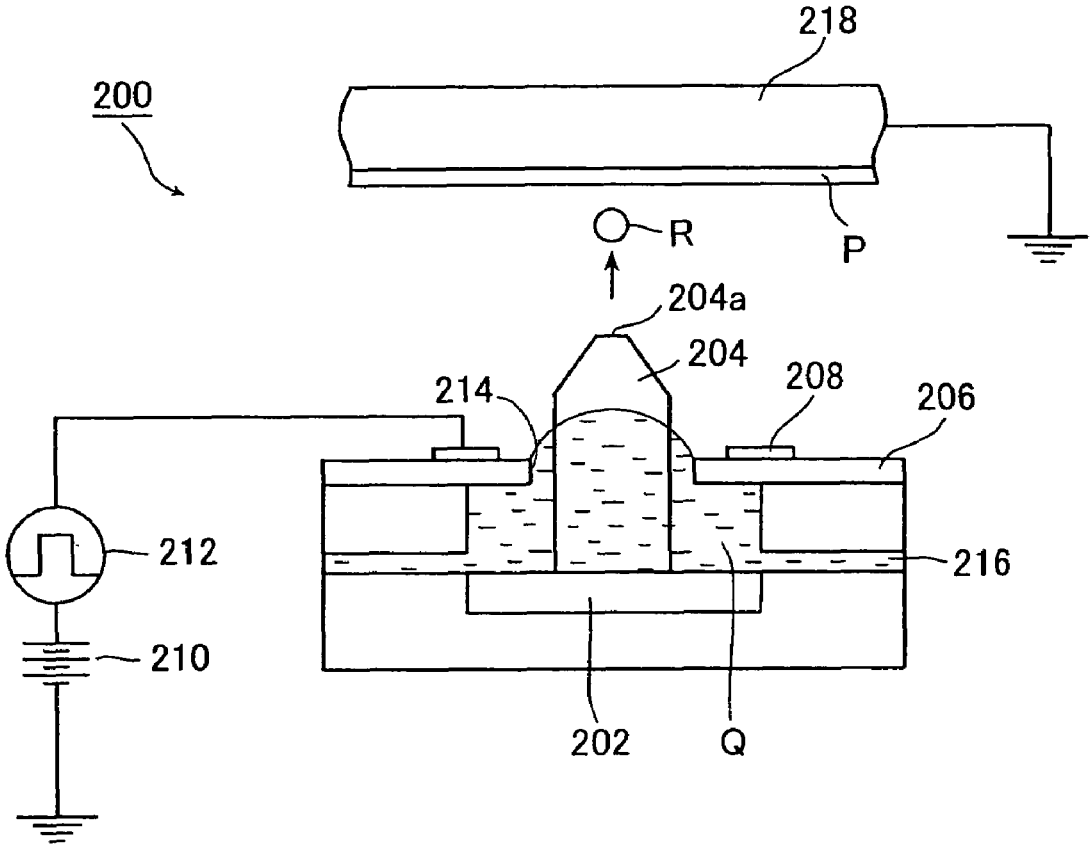
FIG. 9 is a schematic view showing an example of a conventional ink jet head.

An embodiment of the electrical detection means will hereinafter be described with reference to FIG. 8. In this embodiment shown in FIG. 8, other constructions are the same as those of the embodiment shown in FIG. 6 except for a detection portion. Thus, the same constituent elements as those of the embodiment shown in FIG. 6 are designated with the same reference numerals and their detailed descriptions are omitted here. Thus, a point specific to this embodiment will now be selectively described.

A detection portion 160 is connected to the bias electrode 72, and measures a current value of the bias electrode 72 to transmit an output signal corresponding to the measured current value to the arithmetic operation portion 74. Here, when the ink droplet is ejected from the ejection portion 152 as in the above-mentioned embodiment, the ejected ink droplet is adhered to the bias electrode 72. Since when the ejected ink droplet is adhered to the bias electrode 72, a current is caused to flow through the bias electrode 72, a current value detected by the detection portion 160 changes.

As in the above-mentioned embodiment, the arithmetic operation portion 72 subjects the output signal to predetermined processing to obtain current value data, and calculates ejection timings (ejection state) of the ink droplets from changes in current values obtained from the current value data. As in the above-mentioned embodiment, the ejection frequency and the ink concentration can be calculated based on the calculated ejection timings.

An operation of the ink jet recording apparatus 10 will hereinafter be described.

In the ink jet apparatus 10, in recording an image, the recording medium P accommodated in the sheet feeding tray 30 are taken out one by one by the feed roller 32 to be held and conveyed by the conveyance roller pair 36. Each sheet of the recording medium P thus conveyed is then supplied to a predetermined position on the conveyor belt 38.

The recording medium P supplied to the conveyor belt 38 is then charged to a negative high voltage by the charger 44 to be electrostatically attracted to the surface of the conveyor belt 38.

An image corresponding to the image data is recorded on the surface of the recording medium P, which is electrostatically attracted to the surface of the conveyor belt 38, by the recording head 88 while the recording medium P is moved at a predetermined constant speed along with the movement of the conveyor belt 38.

The recording medium P after the image has been recorded thereon is discharged by the discharger 46, and is then separated from the conveyor belt 38 by the separation claw 48 to be supplied to the fixing roller pair 52 along the guide 50. Then, the recorded image on the medium P is heated and fixed while the recording medium P is held and conveyed by the fixing roller pair 52. The resultant sheets each having an image recorded thereon are stocked on top of one another within the discharge tray 34.

As described above, the ink jet recording apparatus for recording an image on the recording medium detects the ink concentration periodically or at an arbitrary timing.

In detecting the ink concentration, the support member 82 of the head unit 54 moves to the position where the support member 82 faces the bias electrode 72. Here, the predetermined voltage (about −1.5 kV) is applied to the bias electrode 72.

Next, a constant voltage (about 600 V) is applied to the ejection portion 152 which is moved so that the flight path of the ejected ink droplets is located between the light emitting element 154 and the light receiving element 156. As a result, the electric field allowing the ink to be ejected is formed in the ejection portion 152. Thus, as described above, the formation of the Taylor cone and the thread and division of the formed thread are caused, the divided thread is ejected in the form of the ink droplets from the ejection portion 152, and the ink droplets pass between the light emitting element 154 and the light receiving element 156 to be adhered to the bias electrode 72.

While the ink droplets are thus ejected from the ejection portion 152, the light receiving element 156 measures a quantity of received light to transmit the output signal corresponding to the quantity of received light to the arithmetic operation portion 74.

The arithmetic operation portion 74 subjects the output signal transmitted from the light receiving element 156 to the predetermined processing such as the A/D conversion processing to obtain the light quantity data, and calculates ejection timings from changes in light quantity data to calculate the ejection frequency from the ejection timings. The arithmetic operation portion 74 calculates the ink concentration from the calculated ejection frequency using the LUT or the like to transmit the data of the calculated ink concentration to the ink concentration adjusting portion 76.

The ink concentration adjusting portion 76 calculates an amount of ink to be added to the ink tank 61 in accordance with the calculated ink concentration the data of which is received from the arithmetic operation portion 74, an amount of ink flowing through the ink circulation system 58, the target ink concentration, and a specified amount of ink to cause the conc. liquid replenishment portion 78 and the diluted liquid replenishment portion 80 to replenish the ink tank 61 with a predetermined amount of ink.

The ejection of the ink droplets is thus detected and the ink concentration is detected based on the ejection state of the ink droplets, whereby the ink concentration can be detected without contacting the ink, and hence the precise ink concentration can be stably detected for a long term.

Moreover, the ink concentration is adjusted based on the detected ink concentration to obtain the suitable ink concentration, and also the ink droplets are stably ejected. Hence, a high-quality image can be recorded stably for a long term.

While in this embodiment, the head unit of a serial head type is adopted, the present invention is not intended to be limited thereto, and thus a head unit of a line head type may also be adopted.

In addition, while in this embodiment, the case where the monochrome image is recorded is adopted, the present invention is not intended to be limited thereto, and thus full color printing using ink of four colors of cyan (C), magenta (M), yellow (Y) and black (K) may also be carried out. In this case, the head units may be provided for the four colors or the ink jet heads of the four colors may be provided in one recording head.

The above-mentioned embodiments are merely illustrative of the present invention and it is to be understood that the present invention is not intended to be limited to those embodiments, and hence various changes and improvements may be suitably made without departing from the scope and spirit of the present invention.

What is claimed is:

1. An ink concentration detecting apparatus for detecting ink concentration of ink containing charged colorant particles, comprising:

ejection detecting means for detecting ink droplets ejected into a predetermined flight path from ink ejection means for ejecting said ink droplets into said predetermined flight path by causing predetermined electrostatic force to act on said ink to thereby detect ejection state of the thus ejected ink droplets, said ejection detecting means being disposed at a position to allow said ejected ink droplets to be detected while flying or having flown said predetermined flight path and detecting said ejected ink droplets at said predetermined flight path; and concentration detecting means for detecting ink concentration of said ejected ink droplets in correspondence to said ejection state of said ejected ink droplets detected by said ejection detecting means to thereby detect said ink concentration of said ink.

2. The ink concentration detecting apparatus according to claim 1, wherein said ejection state is an ejection frequency of said ejected ink droplets, or the number of ejection of said ejected ink droplets per unit time.

3. The ink concentration detecting apparatus according to claim 1, wherein said ejection detecting means includes optical detection means for detecting optically said ejected ink droplets ejected by said ink ejection means and flying said predetermined flight path or electrical detection means for detecting electrically said ejected ink droplets having ejected from said ink ejection means and flown said predetermined flight path.

4. The ink concentration detecting apparatus according to claim 3, wherein said optical detection means includes at least one light emitting portion and at least one light receiving portion which are disposed in positions facing each other across said predetermined flight path of said ejected ink droplets ejected from said ink ejecting means.

5. The ink concentration detecting apparatus according to claim 3, wherein said electrical detection means includes an electrode to which said ejected ink droplet having ejected from said ink ejecting means and flown said predetermined flight path is adhered, and current detecting means for detecting a current which is caused to flow when said ejected ink droplet is adhered to said electrode.

6. The apparatus according to claim 5, wherein the ejection state and the ink concentration are detected based on the amount of the ejected ink droplets landing on the electrode.

7. The apparatus according to claim 1, wherein the ejection detecting means detects the ejection state of the ink droplets when the ink droplets are used for a recordation of an image, and the concentration detecting means detects the ink concentration when the ink droplets are used for the recordation of the image.

8. The apparatus according to claim 1, wherein the predetermined electrostatic force ejects the ink containing the colorant particles to a recording medium.

9. The apparatus according to claim 8, wherein said ink ejection means ejects the ink containing the colorant particles as said ink droplets, wherein the predetermined electrostatic force is caused by an application of a predetermined voltage which causes a predetermined electric field to arise on the ink ejection means.

10. The ink concentration detecting apparatus according to claim 1, wherein said ejection detecting means detects at said predetermined flight path said ink droplets ejected into said predetermined flight path from said ink ejection means and flying or having flown said predetermined flight path.

11. The ink concentration detecting apparatus according to claim 1, wherein said ink ejection means ejects said ink droplets on a recording medium by causing predetermined electrostatic force to act on said ink to record an image on said recording medium.

12. An electrostatic ink jet recording apparatus, comprising:

ink ejecting means for ejecting ink droplets at predetermined frequency corresponding to ink concentration by causing electrostatic force to act on ink containing charged colorant particles; and an ink concentration detecting apparatus for detecting said ink concentration of said ink, wherein said ink concentration detecting apparatus comprises:

ejection detecting means for detecting said ink droplets ejected into a predetermined flight path from said ink ejection means to thereby detect ejection state of said ejected ink droplets ejected by said ink ejecting means, said ejection detecting means being disposed at a position to allow said ejected ink droplets to be detected while flying or when having flown said predetermined flight path and detecting said ejected ink droplets at said predetermined flight path; and concentration detecting means for detecting ink concentration of said ejected ink droplets in correspondence to said ejection state of said ejected ink droplets detected by said ejection detecting means to thereby detect said ink concentration of said ink.

13. The ink jet recording apparatus according to claim 12, further comprising: ink concentration adjusting means for adjusting said ink concentration to be ejected by said ink ejecting means in correspondence to said ink concentration detected by said ink concentration detecting apparatus.

14. The ink jet recording apparatus according to claim 13, wherein said ink concentration adjusting means includes: high concentration ink supplying means for supplying high ink concentration of ink whose ink concentration which denotes concentration of said colorant particles contained in the ink is higher than a reference value; and low concentration ink supplying means for supplying low ink concentration of ink whose ink concentration which denotes said concentration of said colorant particles contained in said ink is lower than said reference value, and wherein, when said ink concentration detected by said ink concentration detecting means is higher than said reference value, said ink concentration adjusting means supplies said high ink concentration of ink from said high concentration ink supplying means, and when said ink concentration detected by said ink concentration detecting means is lower than said reference value, said ink concentration adjusting means supplies said low ink concentration of ink from said low concentration ink supplying means.

15. The ink jet recording apparatus according to claim 12, wherein said ink concentration detecting apparatus detects said ink concentration of said ejected ink droplets independently of recording on a recording medium.

16. The electrostatic ink jet recording apparatus according to claim 12, wherein said ejection detecting mean detects at said predetermined flight path said ink droplets ejected into said predetermined flight path from said ink ejection means and flying or having flown said predetermined flight path.

17. The electrostatic ink jet recording apparatus according to claim 12, wherein said ink ejecting means said ink droplets on a recording medium at said predetermined frequency corresponding to said ink concentration by causing said electrostatic force to act on ink containing charged colorant particles to record an image on said recording medium.

18. An ink concentration detecting method of detecting ink concentration of ink containing charged colorant particles, comprising the steps of:

ejecting ink droplets into a predetermined flight path by causing predetermined electrostatic force to act on said ink;

detecting said ejected ink droplets ejected into said predetermined flight path while flying or when having flown said predetermined flight path to thereby detect ejection state of said ejected ink droplets; and detecting said ink concentration of said ejected ink droplets in correspondence to said detected ejection state of said ejected ink droplets to thereby detect said ink concentration of said ink.

19. The method according to claim 18, wherein the detecting the ejection state of said ejected ink droplets is performed by at least one light emitting portion and at least one light receiving portion which are disposed in positions facing each other across said predetermined flight path of the ejected ink droplets.

20. The method according to claim 18, wherein the detecting the ejection state of said ejected ink droplets is performed by an electrical detection unit which causes an electric current to flow when the ejected ink droplet is adhered to an electrode attached to the electrical detection unit.

21. The ink concentration detecting method according to claim 18, wherein said detecting step of said ejected ink droplets is a step of detecting at said predetermined flight path said ejected ink droplets ejected into said predetermined flight path and flying or having flown said predetermined flight path.

22. The ink concentration detecting method according to claim 18, wherein said ejecting step of said ink droplets ejects said ink droplets on a recording medium by means of ink ejection means for recording an image on said recording medium by causing predetermined electrostatic force to act on said ink droplets.

* * * * *